US007035575B2

(12) United States Patent
Ikeguchi et al.

(10) Patent No.: US 7,035,575 B2
(45) Date of Patent: Apr. 25, 2006

(54) DEVELOPING DEVICE, IMAGE FORMING APPARATUS, AND PROCESS CARTRIDGE

(75) Inventors: Hiroshi Ikeguchi, Tokyo (JP); Katsuhiro Aoki, Tokyo (JP); Hajime Oyama, Tokyo (JP); Daichi Yamaguchi, Tokyo (JP); Yasuo Miyoshi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 126 days.

(21) Appl. No.: 10/825,418

(22) Filed: Apr. 16, 2004

(65) Prior Publication Data

US 2005/0002701 A1 Jan. 6, 2005

(30) Foreign Application Priority Data

| | | |
|---|---|---|
| Apr. 16, 2003 | (JP) | 2003-111990 |
| Jun. 23, 2003 | (JP) | 2003-178024 |
| Aug. 7, 2003 | (JP) | 2003-288683 |
| Jan. 20, 2004 | (JP) | 2004-011793 |
| Mar. 12, 2004 | (JP) | 2004-070055 |

(51) Int. Cl.
*G03G 15/09* (2006.01)

(52) U.S. Cl. ..... 399/267; 399/111; 399/270

(58) Field of Classification Search ..... 399/111, 399/252, 253, 258, 265, 266, 267, 270
See application file for complete search history.

(56) References Cited

U.S. PATENT DOCUMENTS

| | | | | |
|---|---|---|---|---|
| 4,165,393 | A | 8/1979 | Suzuki et al. | |
| 4,171,899 | A | 10/1979 | Yanagawa et al. | |
| 4,193,679 | A | 3/1980 | Mochizuki et al. | |
| 4,194,830 | A | 3/1980 | Ohnuma et al. | |
| 4,201,465 | A | 5/1980 | Oyama et al. | |
| 4,286,543 | A | 9/1981 | Ohnuma et al. | |
| 4,350,749 | A | 9/1982 | Ohnuma et al. | |
| 4,382,420 | A | 5/1983 | Ohnuma et al. | |
| 4,406,536 | A | 9/1983 | Suzuki et al. | |
| 4,760,427 | A | 7/1988 | Oyama et al. | |
| 4,989,043 | A | 1/1991 | Suzuki et al. | |
| 5,083,160 | A | 1/1992 | Suzuki et al. | |
| 5,182,600 | A | 1/1993 | Hasegawa et al. | |
| 5,198,861 | A | 3/1993 | Hasegawa et al. | |
| 5,237,369 | A | 8/1993 | Maruta et al. | |
| 5,241,357 | A * | 8/1993 | Iwata | 399/231 |
| 5,293,198 | A | 3/1994 | Sawayama et al. | |
| 5,339,141 | A | 8/1994 | Suzuki et al. | |

(Continued)

FOREIGN PATENT DOCUMENTS

JP 9-325612 * 12/1997

(Continued)

*Primary Examiner*—Hoan Tran
(74) *Attorney, Agent, or Firm*—Oblon, Spivak, McClelland, Maier & Neustadt, P.C.

(57) ABSTRACT

A developing device configured such that an amount of weakly charged toner in a two-component developer passing through an opening in the device per unit time is not greater than 200 g·mm/min, wherein the amount of weakly charged toner is expressed by an equation, which is the amount of weakly charged toner [g·mm/min] = total amount of the two-component developer to be drawn [g/min] × length of the opening [mm] × a concentration of toner [wt %] × percentage of weakly charged toner [%].

27 Claims, 15 Drawing Sheets

U.S. PATENT DOCUMENTS 5,424,809 A 6/1995 Sawayama et al.
5,424,814 A 6/1995 Suzuki et al.
5,450,177 A 9/1995 Oyama
5,565,973 A 10/1996 Fujishiro et al.
5,619,765 A 4/1997 Tokita et al.
5,638,842 A 6/1997 Tokita et al.
5,655,193 A 8/1997 Fujishiro et al.
5,655,200 A 8/1997 Oyama
5,659,860 A 8/1997 Sasaki et al.
5,689,784 A * 11/1997 Shin et al. ..... 399/285
5,729,562 A 3/1998 Birx et al.
5,758,241 A 5/1998 Oyama et al.
5,771,426 A 6/1998 Oka et al.
5,771,429 A 6/1998 Oyama et al.
5,805,965 A 9/1998 Tsuda et al.
5,822,664 A 10/1998 Oka et al.
5,864,733 A 1/1999 Mae et al.
5,953,568 A 9/1999 Fujishiro et al.
6,163,669 A 12/2000 Aoki et al.
6,295,437 B1 9/2001 Hodoshima et al.
6,463,244 B1 10/2002 Aoki et al.
6,465,144 B1 * 10/2002 Hashimoto et al. ..... 430/106.1
6,505,014 B1 1/2003 Aoki et al.
6,526,248 B1 2/2003 Aoki et al.
6,608,984 B1 8/2003 Matsumoto et al.
6,611,672 B1 8/2003 Aoki et al.
6,658,227 B1 12/2003 Oyama et al.
6,668,147 B1 12/2003 Ikeguchi
6,671,484 B1 12/2003 Miyoshi et al.
6,701,114 B1 3/2004 Sekine et al.
6,707,480 B1 3/2004 Ameyama et al.
6,721,516 B1 4/2004 Aoki et al.

FOREIGN PATENT DOCUMENTS

JP 2834747 * 10/1998
JP 11-237761 * 8/1999
JP 2003-30128 * 2/2003

* cited by examiner

DEVELOPING DEVICE, IMAGE FORMING APPARATUS, AND PROCESS CARTRIDGE

CROSS-REFERENCE TO RELATED APPLICATIONS

The present document incorporates by reference the entire contents of Japanese priority documents, 2003-111990 filed in Japan on Apr. 16, 2003, 2003-178024 filed in Japan on Jun. 23, 2003, 2003-288683 filed in Japan on Aug. 7, 2003, 2004-011793 filed in Japan on Jan. 20, 2004 and 2004-070055 filed in Japan on Mar. 12, 2004.

BACKGROUND OF THE INVENTION

1) Field of the Invention

The present invention relates to a developing device that develops a latent image held on a latent-image carrying unit by a two-component developer which includes toner and a magnetic carrier, an image forming apparatus such as a copying machine, a facsimile, a printer which uses the developing device, and a process cartridge.

2) Description of the Related Art

So far, image forming apparatuses with two-component developing technology in which a two-component developer that contains toner and a magnetic carrier have been known. In this type of image forming apparatus, a developing device that develops a latent image which is held on a latent image carrying unit such as a photosensitive drum, moves a developer carrying unit such as a developing roller etc. in a predetermined direction. With this movement, the developer carrying unit carries a two-component developer in a developer receptacle to a position opposite to the latent image carrying unit. After the two-component developer is used for developing of a latent image, it is returned to the developer receptacle. After the two-component developer that is returned to the developer receptacle is replenished with suitable amount of toner by a toner replenishing unit, it is again held on the developer carrying unit and used for developing. At this time, the newly replenished toner is stirred with the magnetic carrier in the developer receptacle. Due to this stirring, the magnetic carrier particles are rubbed against each other on the developer carrying unit, thereby causing frictional charging.

While there is an advancement in reduction in size of toner with the improvement in image quality in recent years, in such image forming apparatuses which use the two-component developing technology, there is a tendency of forming an image in which there is the so called excessive concentration of toner in which non-image portion is contaminated due to the scatter of toner from a surface of the magnetic carrier. In general, as the toner particle size becomes smaller, the charging is affected. Therefore, the toner is not charged sufficiently after the developer receptacle is replenished with the toner till it is carried to the position opposite to the latent image carrying unit and the toner tends to be scattered due to insufficient charging.

To solve such a problem, in Japanese Patent Application Laid-open Publication No. H11-237761, a toner in which the charging is improved by regulating a peak value and a bottom value of a frequency distribution of a q/d value (where q is an amount of electric charge and d is a diameter of a toner particle) in a predetermined range, has been proposed.

Moreover, in an image forming apparatus equipped with a developing device, during developing, if the toner is adhered on a surface of the latent image carrying unit other than a latent image portion in a developing region, there is a so called contamination of the surface of the medium. The main cause for the contamination is supposed to be faulty charging of toner. In other words, if insufficiently charged toner is carried to the developing region, the toner is adhered on a non latent-image portion where it is not supposed to be adhered, and this toner becomes a contamination on the surface of a medium. Developing units disclosed in Japanese Patent Application Laid-open Publication No. H9-325612 and Japanese Patent No. 2834747 in which such a type of contamination can be suppressed, have been known. In any of these developing devices, toner with which the developing device is replenished, is charged in advance and then the developing device is replenished with this charged toner. This enables to suppress contamination caused due to use of toner that is used for replenishment without being charged sufficiently.

However, in toner disclosed in Japanese Patent Application Laid-open Publication No. H11-237761, during the period of time after the developer receptacle is replenished with toner till it is carried to the position opposite to the latent image carrying unit, the charging is not sufficient necessarily. This is because for charging of the toner, not only the charging capability of the toner but also the parameters related to the charging of the toner such as stirring of the two-component developer, friction characteristics of the magnetic carrier with respect to the toner particles contribute to a great extent. Therefore, even if it is toner disclosed in the Japanese Patent Application Laid-open Publication No. H11-237761, according to the setting of the stirring, there is a possibility that the toner is carried to the position opposite to the latent image carrying unit before being charged sufficiently and scattered conspicuously.

Therefore, the applicant(s) of this patent application in the Japanese Patent Application No. 2003-030128 has (have) proposed an image forming apparatus in which parameters related to the charging of toner in the developing device are set such that the number proportion of toner particles that fulfill the following relational equation A1 in a two-component developer which is held on a surface of a developer carrying unit, is in a range of 0 to 10%.

$$2500m > \mu\frac{0.75}{4\pi\varepsilon_0}\left(\frac{q}{r}\right)^2 \tag{A1}$$

where m: mass of toner particle

μ: coefficient of friction between toner and magnetic carrier

π: ratio of circumference of a circle to it's diameter $\epsilon_0$: dielectric constant in vacuum ($8.85\times10^{-12}$ [F/m])

r: radius of toner particle [m]

q: amount of electric charge on toner particle [c]

According to this invention, due to the reason mentioned below, it is possible to control an image in which there is an excessive concentration of toner due to the scatter of toner. On the developer carrying unit, a two-component developer causes a magnetic carrier to erect or to flatten a magnetic carrier that is erected (hereinafter, "flattening") with a change in the magnetic force that sets the two-component developer towards a surface of the developer carrying unit. When the magnetic carrier is erected or flattened, there is a collision between the particles of the magnetic carrier and shocks of greater or lesser extent are sent to toner that is adhered on surface of the particles of the magnetic carrier. If the inertial force that is developed in the toner due to the shocks becomes greater than adhesion between the toner and the magnetic carrier, the toner is separated from the surface of the magnetic carrier and scattered. Thus, since for the insufficiently charged toner particles, the inertial force becomes greater than the static electrical adhesion, the relational equation A1 is derived. On the developer carrying unit, if the proportion of the toner particles which fulfill the relational equation A1 becomes greater, the scatter of the toner increases to an extent such that the excessive concentration of toner in the image becomes conspicuous. Based on such a consideration, experiments were carried out and a relationship between a proportion of toner particles which fulfill the relation mentioned above and scatter of the toner was examined. As a result of the experiment it was found that if the number percentage of the insufficiently charged toner particles which fulfill the relationship mentioned above, is controlled below 10 [%], it is possible to reduce the scatter of toner to an extent that there is no excessive concentration of toner.

Thus, in the patent application mentioned above, the scatter of the toner is reduced by reducing the proportion of toner with less charging in the two-component developer that is held on the surface of the developer carrying unit by regulating the amount of electric charge q in toner particle and the diameter d of toner particle. However, the level of scatter of the toner in the actual developing device, is affected not only by the proportion of the insufficiently charged toner in the two-component developer that is held on the surface of the developer carrying unit but also by the linear velocity of the developer carrying unit, the amount of developer that is held on the developer carrying unit, the size of opening of the developing device etc. Concretely, the scatter of the toner increases with increase in the linear velocity of the developer carrying unit, increase in the amount of developer held by the developer carrying unit, rise in the density of the toner, and widening of the area of the opening, and increase in the density of the toner. Therefore, taking into consideration the effect of these factors, it would be useful to regulate the conditions that control the scatter of toner in the developing device.

Even if it is a toner according to Japanese Patent Application Laid-open Publication No. H11-237761, in reality, proportion of inclusion of the toner with less charging and toner with big particle size is high. As it is mentioned in the latter part, the toner with less charging and the toner with big particle size has weak electrostatic adhesion with a carrier. Therefore, even if it is a toner according to Japanese Patent Application Laid-open Publication No. H11-237761, there is a possibility of conspicuous scatter of the toner. Moreover, in the Japanese Patent Application Laid-open Publication No. H11-237761, effect of a change in the movement of a magnetic brush that is formed on the developer carrying unit on the toner is not taken into consideration.

According to the conventional technology, even if the toner is charged sufficiently, there is a possibility of contamination of the surface of the medium. This is due to the reason given below.

In a case of using the two-component developer, due to the electrostatic attraction between toner and a magnetic carrier (toner carrier) that is charged with a charge of polarity opposite to that of the toner, the toner is carried to a developing region in a state of being adhered on the magnetic carrier. When the toner is carried, if the amount of toner adhered on the magnetic carrier is large, in a part of the toner, there are particles which have weak electrostatic attraction with the magnetic carrier. If toner having weak electrostatic attraction with the magnetic carrier is carried to the developing region, even if the toner is charged sufficiently, in the developing region, it falls apart from the magnetic carrier and is adhered on a non latent-image portion of the latent image carrying unit. The contamination is considered to be occurring as a result of this.

The phenomenon mentioned above is not limited to the two-component developer and can occur similarly even if it is a one-component developer that includes a toner which does not include a magnetic carrier. In other words, in a case of the one-component developer, the toner is carried to a developing region in a state of being adhered on a surface due to the electrostatic attraction between the toner and a surface of a developing roller that is charged with a charge of polarity opposite to that of the toner. In this case also, when the toner is carried, if the amount of toner adhered on the surface of the developing roller per unit area is large, in a part of the toner, there are particles which have weak electrostatic attraction with the surface of the developing roller. Therefore, even if the toner is charged sufficiently, in the developing region, the toner falls apart from the surface of the developing roller and is adhered on a non latent image portion of the latent image carrying unit, which may cause contamination on a surface of the medium.

SUMMARY OF THE INVENTION

It is an object of the present invention to solve at least the problems in the conventional technology.

A developing device according to an aspect of the present invention includes: a developer carrying unit including a non-magnetic sleeve rotatable and a magnetic field generating unit; a developer receptacle configured to receive a two-component developer including toner and a magnetic carrier; and an opening through which a portion of the developer carrying unit opposite to a latent image carrying unit configured to carry a latent image is exposed, wherein the magnetic field generating unit is configured to draw the two-component developer onto a surface of the developer carrying unit so as to carry the two-component developer to the opening, form a magnetic brush by erecting the two-component developer on the developer carrying unit at the opening, apply a developing bias on the developer carrying unit so as to develop the latent image with the toner supplied to the latent image on the latent image carrying unit from the magnetic brush, and an amount of weakly charged toner in the two-component developer passing through the opening per unit time is not greater than 200 g·mm/min, wherein the amount of weakly charged toner is expressed by an equation, which is $$\text{the amount of weakly charged toner [g·mm/min]} = \text{total amount of the two-component developer to be drawn [g/min]} \times \text{length of the opening [mm]} \times \text{a concentration of toner [wt \%]} \times \text{percentage of weakly charged toner [\%]}$$

wherein the total amount of the two-component developer to be drawn is expressed by an equation, which is the total amount of the two-component developer to be drawn [g/min] = an amount of the two-component developer to be drawn [g/mm$^2$] × drawing width [mm] × linear velocity of a developing roller [mm/min]

and the percentage of weakly charged toner [%] is a percentage of toner having a charge of not less than −0.1 fC/μm if the toner is negatively charged, and is a percentage of toner having a charge not greater than 0.1 fC/μm if the toner is positively charged, according to a distribution of charge per particle size.

An image forming apparatus according to another aspect of the present invention includes: a latent image carrying unit configured to carry a latent image; a developing device configured to supply toner to the latent image so as to develop the latent image on the latent image carrying unit into a toner image; a transferring device configured to transfer the toner image to a medium, wherein the developing device comprises: a developer carrying unit including a non-magnetic sleeve rotatable and a magnetic field generating unit; a developer receptacle configured to receive a two-component developer including toner and a magnetic carrier; and an opening through which a portion of the developer carrying unit opposite to the latent image carrying unit is exposed, wherein the magnetic field generating unit is configured to draw the two-component developer onto a surface of the developer carrying unit so as to carry the two-component developer to the opening, form a magnetic brush by erecting the two-component developer on the developer carrying unit at the opening, apply a developing bias on the developer carrying unit so as to develop the latent image with the toner supplied to the latent image on the latent image carrying unit from the magnetic brush, and an amount of weakly charged toner in the two-component developer passing through the opening per unit time is not greater than 200 g·mm/min, wherein the amount of weakly charged toner is expressed by the equation according to the above aspect.

A process cartridge according to still another aspect of the present invention includes: a latent image carrying unit configured to carry a latent image; and a developing device configured to supply toner onto the latent image so as to develop the latent image, wherein the latent image carrying unit and the developing device are structured as an integrated unit, the process cartridge is detachably connected to an image forming apparatus, and the developing device comprises: a developer carrying unit including a non-magnetic sleeve rotatable and a magnetic field generating unit; a developer receptacle configured to receive a two-component developer including toner and a magnetic carrier; and an opening through which a portion of the developer carrying unit opposite to the latent image carrying unit is exposed, wherein the magnetic field generating unit is configured to draw the two-component developer onto a surface of the developer carrying unit so as to carry the two-component developer to the opening, form a magnetic brush by erecting the two-component developer on the developer carrying unit at the opening, apply a developing bias on the developer carrying unit so as to develop the latent image with the toner supplied to the latent image on the latent image carrying unit from the magnetic brush, and an amount of weakly charged toner in the two-component developer passing through the opening per unit time is not greater than 200 g·mm/min, wherein the amount of weakly charged toner is expressed by the equation according to the above aspect.

An image forming apparatus according to still another aspect of the present invention includes: a latent image carrying unit; a developing device including a surface conveyor configured to convey toner charged to a predetermined polarity adhered electrostatically on a toner carrier charged to a polarity opposite to that of the toner charged to a developing region opposite to a surface of the image carrying unit, wherein in the developing region, the developing device is configured to transfer on a medium a toner image formed of the toner adhered on a latent image on a surface of the latent image carrying unit so as to form an image on the medium; and a toner-amount adjusting unit configured to adjust an amount of toner to be adhered on the toner carrier before the surface conveyor conveys the toner to the developing region such that in the developing region a total charge on the toner adhered on the toner carrier is not greater than a total charge on the toner carrier.

A process cartridge according to still another aspect of the present invention is detachable from an image forming apparatus, wherein the image forming apparatus comprises: a latent image carrying unit; a developing device including a surface conveyor configured to convey toner charged to a predetermined polarity adhered electrostatically on a toner carrier charged to a polarity opposite to that of the toner charged to a developing region opposite to a surface of the image carrying unit, wherein in the developing region, the developing device is configured to transfer on a medium a toner image formed of the toner adhered on a latent image on a surface of the latent image carrying unit so as to form an image on the medium; and a toner-amount adjusting unit configured to adjust an amount of toner to be adhered on the toner carrier before the surface conveyor conveys the toner to the developing region such that in the developing region a total charge on the toner adhered on the toner carrier is not greater than a total charge on the toner carrier, wherein the process cartridge comprises at least the latent image carrying unit, the developing device, and the toner-amount adjusting unit, which are structured as an integrated unit.

A developing device according to still another aspect of the present invention includes: a latent image carrying unit; a developer receptacle having an opening facing the latent image carrying unit; and a developer carrying unit configured to be partially exposed to an inside of the developer receptacle through the opening, carry as a magnetic brush a two-component developer including toner and a carrier with a magnetic field generating unit included in the developer carrying unit, and supply the toner to a latent image on the latent image carrying unit in a developing region opposite to the latent image carrying unit, wherein a proportion of the toner satisfying equations, which are, $$\mu Fq < Fdmax \tag{C1}$$

$$Fq = \frac{k}{4\pi\varepsilon_0}\left(\frac{q}{r}\right)^2 \tag{C2}$$

$$Fdmax = \frac{4}{3}\pi \cdot r^3 \cdot \sigma \cdot a \tag{C3}$$

is not greater than 10%, wherein Fq is an electrostatic adherence of the toner with respect to the carrier in the two-component developer, Fdmax is a maximum inertial force exerted on the toner at the opening, μ is a coefficient of kinetic friction, π is pi, $\in_0$ is a dielectric constant in vacuum [F/m], k is a constant, q is an electric charge on toner particles [C], r is a radius of the toner particles [m], σ is a density [kg/m$^2$], and a is a change in velocity of the magnetic brush [m/s$^2$].

A process cartridge according to still another aspect of the present invention includes: an image carrying unit configured to carry an electrostatic latent image; and a developing device configured to convey a developer carried on a developer carrying unit to a developing region opposite to the image carrying unit and to develop a latent image on the image carrying unit to form a toner image, wherein the process cartridge is configured to be detachable from an image forming apparatus, wherein the image forming apparatus comprises: the image carrying unit; a charging unit configured to charge the image carrying unit; the developing device; and a cleaning unit configured to remove toner remained on the image carrying unit after the toner image is transferred onto a medium, wherein the developing device comprises: the latent image carrying unit; a developer receptacle having an opening facing the latent image carrying unit; and a developer carrying unit configured to be partially exposed to an inside of the developer receptacle through the opening, carry as a magnetic brush a two-component developer including toner and a carrier with a magnetic field generating unit included in the developer carrying unit, and supply the toner to a latent image on the latent image carrying unit in a developing region opposite to the latent image carrying unit, wherein a proportion of the toner satisfying the equations according to the above aspect is not greater than 10%.

The other objects, features, and advantages of the present invention are specifically set forth in or will become apparent from the following detailed description of the invention when read in conjunction with the accompanying drawings.

DETAILED DESCRIPTION

Exemplary embodiments of an electrophotographic image forming apparatus relating to the present invention are described in the order of a first embodiment to a fourth embodiment.

Figure 1:
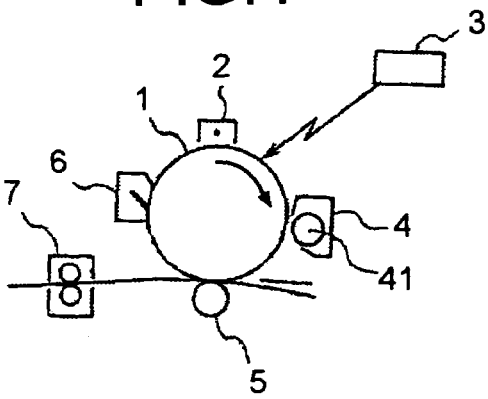
FIG. 1 is a schematic diagram of an image forming apparatus according to a first embodiment.

To start with, a schematic structure and an operation of an image forming apparatus are described below. FIG. 1 is a schematic diagram of an image forming apparatus. The image forming apparatus includes a photosensitive drum 1 which is a latent image carrying unitimage carrying unit around which a charging unit 2, an exposing unit 3, a developing device 4, a transferring device 5, and a cleaning unit 6 are disposed. Further, the image forming apparatus includes a paper feeding unit that is not shown in the diagram and a fixing unit 7. The paper feeding unit feeds a transfer paper towards a section opposite to the photosensitive drum 1 and the transferring device 5 from a paper feeding tray which is not shown in the diagram. The fixing unit 7 fixes toner on the transfer paper after the transfer paper is separated from the photosensitive drum 1 upon transferring of a toner image on it.

The photosensitive drum 1 includes a pipe made of aluminum etc. with an organic photosensitive layer formed on a surface of the pipe. The photosensitive drum 1 is driven by rotating in a direction of an arrow in the diagram by a driving unit that is not shown in the diagram. After the uniform charging of the rotating surface of the photosensitive drum 1 to a predetermined electric potential at the charging unit 2, the surface of the photosensitive drum 1 is scanned and irradiated by a laser beam that is modulated based on image information in an axial direction of the photosensitive drum 1. As a result of this, an electrostatic latent image is formed on the photosensitive drum 1. The electrostatic latent image formed on the photosensitive drum 1 is developed in a developing region opposite to the developing device 4 by adhesion of toner that is charged by the developing device 4 and becomes a toner image. On the other hand, a transfer paper is fed and carried by the paper feeding unit and is delivered with a predetermined timing to a transferring section which is opposite to the photosensitive drum 1 and the transferring device 5.

Further, the transferring device 5 transfers the toner image that is formed on the photosensitive drum 1 on a transfer paper by applying an electric charge of a polarity opposite to that of the toner image on the photosensitive drum 1. The transfer paper is separated apart from the photosensitive drum 1 and then sent to the fixing unit 7. The transfer paper on which the toner image is fixed at the fixing unit 7 is output. The surface of the photosensitive drum 1 after the toner image is transferred at the transferring device 5 is cleaned at the cleaning unit 6 where the toner remained-on the photosensitive drum 1 is removed. The surface of the photosensitive drum 1 which has passed through the cleaning unit 6 is charged uniformly by the charging unit 2 and the next image formation is repeated.

Figure 2:
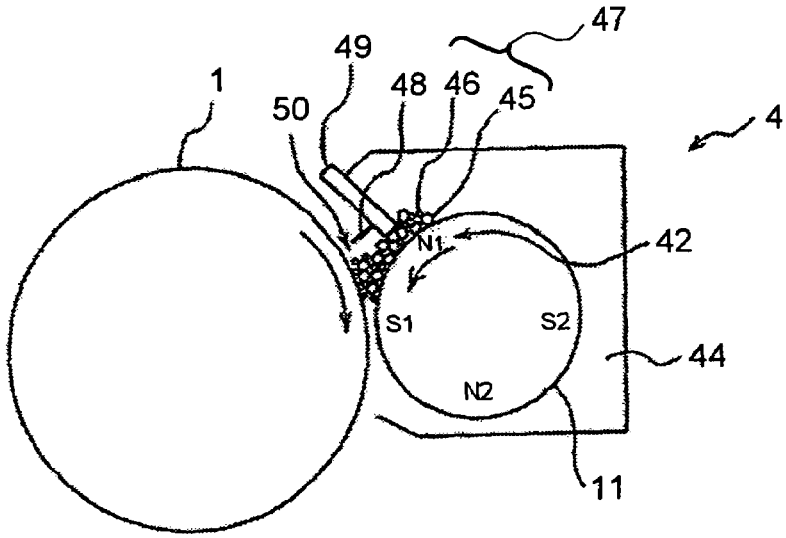
FIG. 2 is a schematic diagram of a developing device that is used in the image forming apparatus.

FIG. 2 is a schematic diagram of the developing device 4 used in the image forming apparatus according to the first embodiment. The developing device 4 includes an opening 50 that is opposite to the photosensitive drum 1, and a developing sleeve 41. A part of the developing sleeve 41 is exposed from the opening 50. The non-magnetic and rotatably connected developing sleeve 41 is provided as a developer carrying unit opposite to the photosensitive drum 1 at a predetermined distance. A plurality of magnets 42 are fixed inside the developing sleeve 41 as a magnetic field generating unit. The developing device 41 further includes a developer receptacle 44, a carrier screw, and a doctor 49. The developer receptacle 44 contains a two-component developer 47 (hereinafter, "developer") which includes a toner 46 and a magnetic carrier 45. The carrier screw which is not shown in the diagram is for stirring the developer in the developer receptacle 44. The doctor 49 regulates an amount of developer on the developing sleeve 41. The developer receptacle 44 includes at its bottom, a toner-concentration sensor which is not shown in the diagram. The developing device further includes an inlet seal 48. The inlet seal 48 is made of a flexible material and is provided on a down-stream side of the doctor 49 in a direction of rotation of the developing sleeve 41 such that the inlet seal 48 covers the developer. In the present embodiment, the diameter of the developing sleeve $\phi$ is let to be 18 millimeter (mm) and a surface of the developing sleeve is sand blasted or subjected to a process in which a plurality of grooves of depth from one mm to a few mm are formed such that the roughness of the surface Rz is in a range of 10 micrometers (μm) to 20 μm. The magnets 42 include a main magnetic pole (a developing magnetic pole), a developer carrying unit pole, and a developer drawing pole, and have four poles in an order of an N pole (N1), an S pole (S1), an N pole (N2) and an S pole (S2) in a direction of rotation of the developing sleeve 41 from a portion opposite to the doctor 49. However, the arrangement of the magnetic poles of the magnets 42 is not limited to a structure shown in FIG. 2 and may also be set according to the size of the developing sleeve 41, the position of the doctor 49 around the developing sleeve 41 etc. The magnetic pole S1 is the main magnetic pole that is disposed on a rear side of the developing sleeve 41 in the developing region opposite to the photosensitive drum 1 and the developing sleeve 41 and has the strongest magnetic force among the five magnetic electrodes. The magnetic pole S1 forms a magnetic brush by causing the developer 47 on the developing sleeve 41 to erect in the developing region.

The developer 47 in the developer receptacle 44 of the developing device 4 which includes the toner 46 and the magnetic carrier 45 is carried close to the developing sleeve 41 while being charged by friction to a predetermined polarity due to rotation of the carrier screw. The developer 47 is drawn to the surface of the developing sleeve 41 by the magnetic force of the magnetic pole S2 of the magnets 42 inside the magnetic sleeve 41 and is carried in the same direction as the direction of rotation of the developing sleeve 41 that is driven and rotated in the direction of the arrow. Further, the thickness of a layer of the developer 47 is regulated by the doctor 49 that is at a predetermined distance from the surface of the developing sleeve 41 and opposite to the surface of the developing sleeve 41, and a fixed quantity of the developer 47 is held on the developing sleeve 41 and carried up to the opening 50 and faces the photosensitive drum 1. On the other hand, the developer 47 that is left after being regulated by the doctor 49 is returned to the developer receptacle 44. Thus, by regulating the thickness of the layer while being drawn by the surface of the developing sleeve 41, the frictional charging of the toner in the developer 47 is accelerated. According to the first embodiment, a distance between the doctor 49 and the developing sleeve 41 when they are close to each other is set to 0.8 mm and the magnetic pole N1 of the magnets 42 opposite to the doctor 49 is disposed in a position inclined by few degrees in an upstream side of the doctor 49 in the direction of rotation of the developing sleeve 41. Due to this, a circulation flow in which the developer 47 that is left after regulating the passing, returns to the developer receptacle 44 from the doctor 49, can be formed easily. Further, a desirable range of an amount of charging of the toner is from −10 μC/g to −25 μC/g.

In a developing region opposite to the photosensitive drum 1, a magnetic brush is formed on the developing sleeve 41 due to the magnetic force of the electrode S1 of the magnets 42, which moves in a direction same as that of the movement of the photosensitive drum 1 with a speed faster than that of the photosensitive drum 1 and is allowed to pass while the tip of the magnetic brush scrapes the photosensitive drum 1.

At this time, a developing bias VB is applied to the developing sleeve 41 by a power supply that is not shown in the diagram. A developing potential acts on toner at the tip of the magnetic brush that scrapes the photosensitive drum 1 and a toner image is formed by an electrostatic transfer from the surface of the magnetic carrier to a latent image portion of the photosensitive drum 1. The magnetic brush is returned to the developer receptacle 44 after passing through the developing region with the rotation of the developing sleeve 41.

Moreover, a toner replenishing unit which is not shown in the diagram is connected to the developer receptacle 44 and replenishes the new toner according to the requirement. Concretely, the toner-concentration sensor that is provided at the bottom of the developer receptacle 44 detects the toner concentration of the developer 47 carried by the carrier screw into the developer receptacle 44. Based on the result of the detection, the toner replenishing unit is driven and replenishes the developer receptor 44 with the toner according to the requirement, thereby maintaining the toner concentration T.C. of the developer in the developer receptacle 44 in a predetermined range.

The following is a description of the developer.

The toner 46 in the developer 47 contains a resin such as polyester, polyol, styrene acrylic etc. with a charge controlling agent (CCA) and a coloring material mixed in it and an additive such as silica and titanium oxide added around it to improve the fluidity. The particle size of the additive is in a range of 0.1 μm to 1.5 μm. Carbon black, phthalocyanine blue, quinacridone, carmine etc. are examples of the coloring material.

By including a magnetic material in the toner 46, the toner can be used as magnetic toner. The concrete examples of the magnetic material are, iron oxides such as magnetite, hematite, ferrite, metals such as cobalt and nickel or alloys or compounds of metals such as cobalt and nickel with a metal such as aluminum, copper, lead, magnesium, tin, zinc, antimony, beryllium, bismuth, cadmium, calcium, manganese, selenium, titanium, tungsten, vanadium etc. The desirable average particle size of the magnetic material is 0.1 μm to 2 μm and the desirable amount of the magnetic material to be included is in a range of 20 parts by mass to 200 parts by mass with respect to 100 parts by mass of a binder resin and a more desirable amount of the magnetic material is in a range of 40 parts by mass to 150 parts by mass with respect to 100 parts by mass of a binder resin.

Additives which have been known conventionally can be used. Concretely, the examples of additives are oxides and complex oxides of silicon (Si), titanium (Ti), aluminum (Al), magnesium (Mg), calcium (Ca), strontium (Sr), barium (Ba), indium (In), gallium (Ga), nickel (Ni), manganese (Mn), tungsten (W), iron (Fe), cobalt (Co), zinc (Zn), chromium (Cr), molybdenum (Mo), copper (Cu), silver (Ag), vanadium (V), and zirconium (Zr). In particular, silica, titania, and alumina which are oxides of Si, Ti, and Al are desirable as an additive. The desirable amount of additive is 0.5 parts by mass to 1.8 parts by mass with respect to 100 parts by mass of a host particle and an amount of 0.7 parts by mass to 1.5 parts by mass is more desirable. If the amount of the additive is less than 0.5 parts by mass, the fluidity of the toner is deteriorated resulting in insufficient charging and causing contamination of surface of the medium and the scatter of toner. If the amount of the additive is more than 1.8 parts by mass, the fluidity is improved on one hand whereas due to chattering and rolling of a blade, there tend to be improper cleaning of the photosensitive drum 1 and filming of additive that is separated apart from the toner on the photosensitive drum 1. This results in the deterioration of durability of the cleaning blade and the photosensitive drum 1 and the deterioration of fixing. Further, the toner tends to scatter in a thin line portion and particularly in a case of an output of thin line in a full-color image, due to a need to superimpose at least two colors, the scatter in a thin line portion tends to be conspicuous with an increase in the amount of toner adhered. In a case of color toner, if there is an excessive amount of an additive, when a toner image formed on a transparent sheet is projected by an overhead projector, there is a shadow in a projected image, and it is difficult to achieve a clear projected image.

Various methods have been known for measurement of an amount of additive, and a fluorescent X-ray spectroscopy is used in general for the measurement. According to this method, for a toner for which the additive content is already known, a calibration curve is prepared by the fluorescent X-ray spectroscopy and the additive content is calculated by using the calibration curve.

It is desirable that additive is subjected to a surface treatment to have hydrophobicity, improved fluidity, and charging control, according to the requirement. Compounds such as a compound of organic silane are desirable to be used as a treatment agent for the surface treatment. The examples of the compounds of organic silane are alkylchlorosilanes such as methyltrichlorosilane, octyltrichlorosilane, and dimethyldichlorosilane, and alkylmethoxysilanes such as dimethyldimethoxysilane and octyltrimethoxysilane. Hexanedimethyldisilazane and silicone oil can also be used. A method in which an additive is soaked in a solution that contains the compound of organic silane, and then dried and a method in which a solution containing the compound of organic silane is sprayed on an additive, and then dried are examples of a method for the surface treatment.

It is desirable to use a toner that has a volume average particle size in a range of 3 μm to 7 μm. In the image forming apparatus according to the first embodiment, toner having the volume average particle size 6.8 μm is used and this toner can cope sufficiently with an image of high resolution of not less than 1200 dots per inch (dpi). Further, in the first embodiment, the toner 46 which has a negative polarity of charging is used and a toner with a positive polarity of charging can also be used according to the polarity charging of the photosensitive drum 1.

Conventionally known materials such as a magnetic resin carrier, magnetite powder, ferrite powder, and iron powder of a particle size in a range of 20 μm to 200 μm can be used as the magnetic carrier 45. In the image forming apparatus according to the first embodiment, a magnetic carrier of an average particle size 55 μm which has a magnetic material such as ferrite inside a core made of a metal or a resin and an outer layer of the core coated with a silicon resin etc. is used. Amino resins such as urea-formaldehyde resins, melamine resins, benzoguanamine resins, urea resins, polyamide resins, and epoxy resins can be used as a coating material for the outer surface. Further, polyvinyl resins, polyvinylidine resins, acrylic resins, polymethyl methacrylate resins, polyacrylonitrile resins, polyvinyl acetate resins, polyvinyl alcohol resins, polyvinyl butyral resins, polystyrene resins etc. may also be used. Moreover, polystyrene resins such as styrene acrylic copolymer resins, olefin halide resins such as polyvinyl chloride resins, polyester resins such as polyethylene terephthalate resins and polybutylene terephthalate resins may also be used. Further, polycarbonate resins, polyethylene resins, polyvinyl fluoride resins, polyvinylidene fluoride resins, polytrifluoroethylene resins, polyhexafluoropropylene resins, copolymers of vinylidene fluoride and acrylic monomers may also be used. Moreover, copolymers of vinylidene fluoride and vinyl fluoride, fluoroterpolymers such as terpolymers of tetrafluoroethylenes and vinylidene fluorides, and non-fluorinated monomers, and silicone resins may also be used. A conducting powder may also be added to the coating resin according to the requirement. Metal powders, carbon black, titanium oxide, tin oxide, zinc oxide etc. can be used as the conducting powder. Conducting powders having an average particle size not greater than 1 μm are desirable. This is because, if the average particle size is greater than 1 μm, the control of electric resistance becomes difficult.

The desirable proportion of the magnetic carrier 45 and the toner 46 in the developer 47 is 1 part by mass to 10 parts by mass of the toner with respect to 100 parts by mass of the carrier.

The following is a description of a peculiar structure of the image forming apparatus according to the first embodiment. The scatter of the toner in the developing device 4 is affected not only by the proportion of the insufficiently charged toner in the developer that is held on the surface of the developing sleeve 41 but also by the linear velocity of the developing sleeve 41, the amount of developer that is held on the developing sleeve 41, and the size of the opening 50. Taking into consideration the influence of these factors, the amount of weakly charged toner that passes through the opening 50 per unit time was calculated by an equation given below and regulating the amount of toner by this equation was considered to be effective in suppressing the scatter of toner.

Amount of weakly charged toner that passes through the opening 50 per unit time [g·mm/min] = total amount to be drawn [g/min] × length of opening [mm] × concentration of toner *T.C.* [wt %] × proportion *WST* [%] of weakly charged toner.

Figure 3:
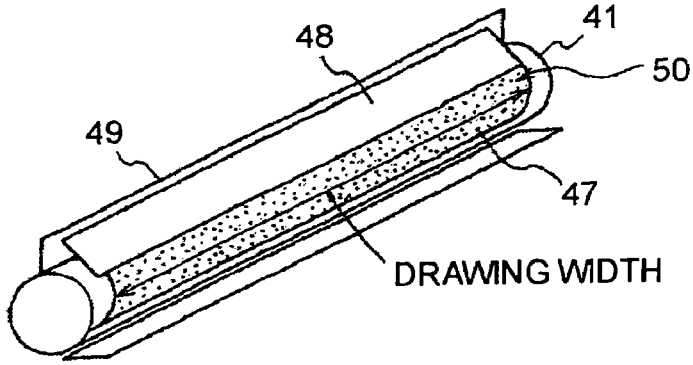
FIG. 3 is an illustration of a developer-drawing width of the developing device.
Figure 4:
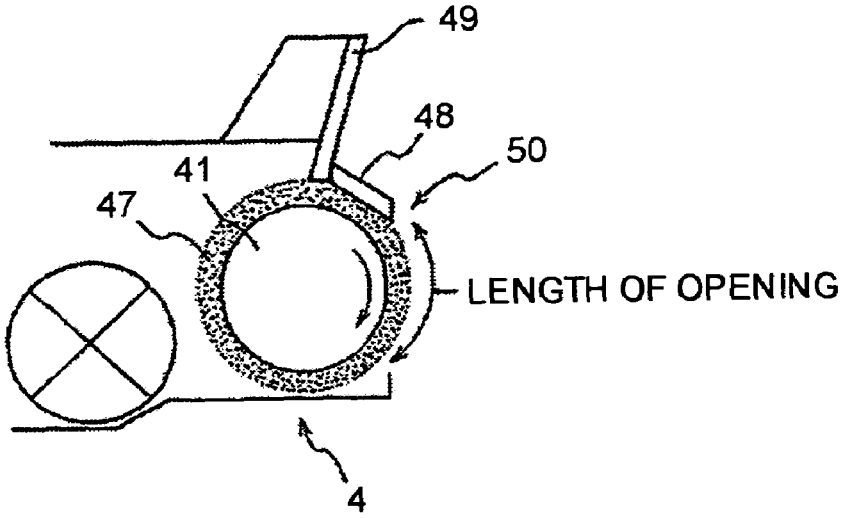
FIG. 4 is an illustration of a length of an opening of the developing device.
Figure 5:
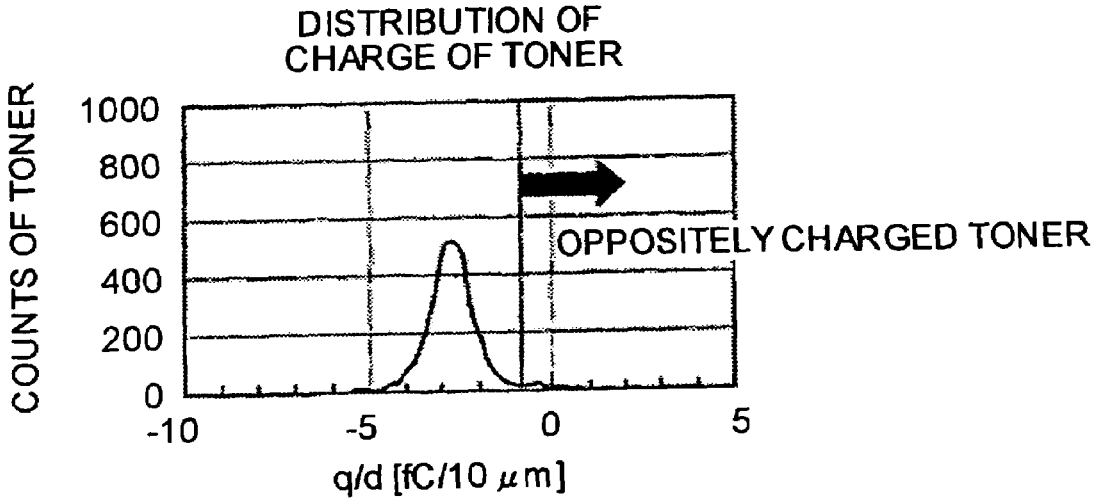
FIG. 5 is a graph of a distribution q/d of an amount of electrostatic charge of toner measured by an E-SPART analyzer.

In this case, an equation, the total amount to be drawn [g/min]=amount to be drawn [g/mm$^2$]×width of drawing [mm]×linear velocity of the developer carrying unit [mm/min] indicates that the amount of weakly charged toner passing through the opening 50 per unit time increases not only with the proportion WST [%] of the weakly charged toner but also with the increase in the amount to be drawn, the increase in the linear velocity of the developer carrying unit, the widening of the area of the opening 50, and the increase in the density of the toner. Further, larger the quantity of the weakly charged toner that passes through the opening 50 per unit time, the scatter of the toner is considered to be conspicuous. FIG. 3 is a developer-drawing width of the developing device 4 and FIG. 4 is an illustration of the length of the opening 50 of the developing device 4. When the amount of charging q and the particle size d of the toner are measured and in the q/d distribution that is calculated, if the toner is negatively charged, the proportion WST [%] of the weakly charged toner which is a proportion of the toner with an amount of electric charge not less than −0.1 fC/μm, is used, and if the toner is positively charged, the proportion WST [%] of the weakly charged toner which is a proportion of the toner with an mount of electric charge not greater than 0.1 fC/μm, is used. This is because it was found in an experiment mentioned in the latter part that not only for a toner that is charged with an opposite polarity, if it is a negatively charged toner, a toner having an amount of charging not less than −0.1 fC/μm and if it is a positively charged toner, a toner having an amount of charging not more than 0.1 fC/μm contributes greatly to the scatter of toner. An analyzer (product name: E-SPART analyzer) manufactured by HOSOKAWA MICRON COMPANY was used for measurement of the amount of charging of the toner and the particle size. This analyzer employs a method in which a double beam, frequency shift type of laser Doppler speedometer and an acoustic wave that causes the motion of particles to perturb in a static electric field are used. By employing this method, air is blown on the toner on the developing sleeve 41 and the motion in the electric field is detected thereby acquiring data of the amount of charging and the particle size of each toner. q/d of toner measured by the E-SPART analyzer is shown in FIG. 5.

An amount to be drawn by the doctor 49 was set to 80 mg/cm$^2$ and the linear velocity of the developing sleeve was set to be 278 mm/sec. The drawing width was let to be 320 mm and a paper of size A3 was allowed to be output. The inlet seal 48 has been provided for not exposing the developer immediately after passing of the doctor 49 and the length of the opening 50 is adjusted to 10 mm thereby reducing the area of the opening 50. Further, it was possible to adjust the proportion WST [%] of the weakly charged toner that was measured by the E-SPART analyzer to 2.3%. In this developing device 4, if a developer that has a toner concentration 5% by mass is used, an amount of the weakly charged toner that passes through the opening per unit-time becomes 50 g·mm/min. Regarding a method for measuring the amount of scattered toner, only the developing device 4 was driven in a tightly closed space and weight of toner that was splattered from the developing device 4 and adhered on the surrounding was measured. Further, from another experiment, when the amount of toner scattered per minute was controlled to be not more than 60 mg, it was found that there was no contamination of inside of the unit and not contamination of surface of the image on the medium.

Figure 6:
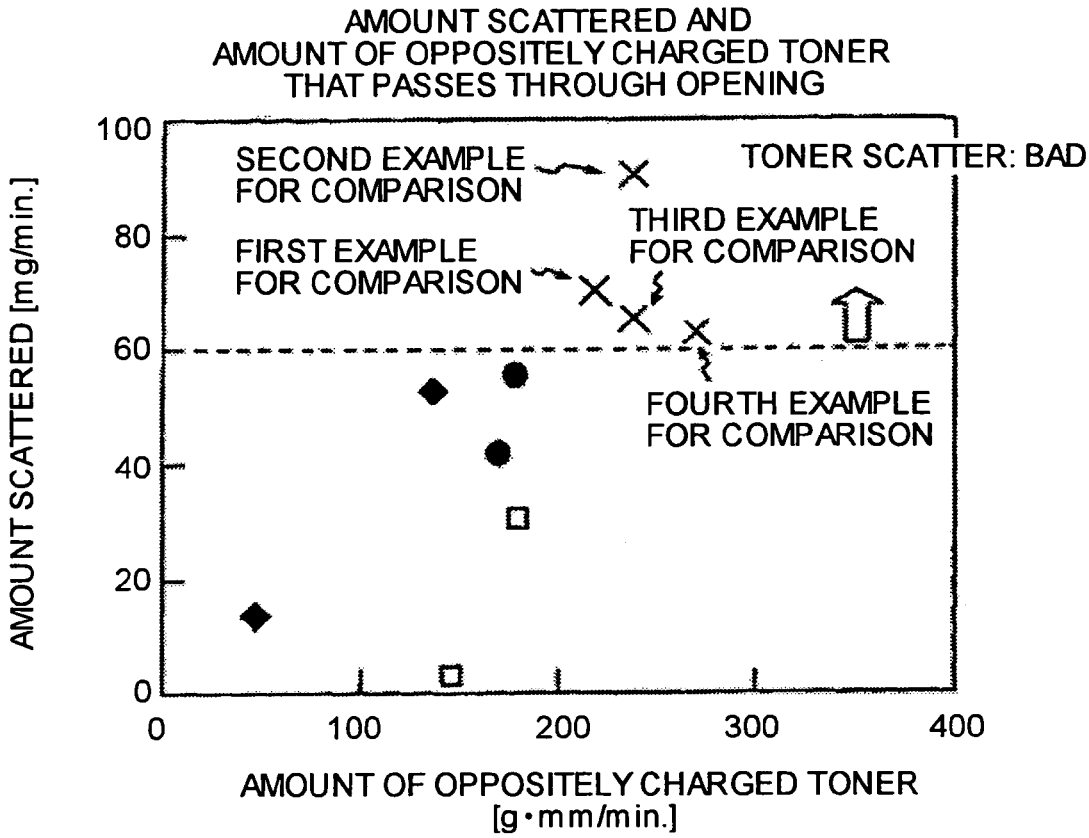
FIG. 6 is a graph of a relationship between an amount of weakly charged toner that passes through the opening per unit time and an amount of scatter of toner.

A graph of a relationship between an amount of the weakly charged toner that passes through the opening per unit time and the amount of scatter of toner is shown in FIG. 6. In a first example, the density of the toner in the developer in the developing device 4 was let to be 5% by mass and 7% by mass. The relationship between the amount of the weakly charged toner that passes through the opening per unit time and the amount of scatter of toner was examined and was shown in FIG. 6 with (♦). As shown in FIG. 6, for both the densities 5% by mass and 7% by mass, the amount of the weakly charged toner passing through the opening 50 per unit time was not more than 200 g·mm/min and the amount of toner scattered was not more than 60 mg, which is a tolerable level. Actual image forming was carried out and it was confirmed that there was no contamination in the unit and no contamination of the surface of the medium.

In a first example for comparison, a developer for which the an amount of toner charged to the opposite polarity that passes through the opening per unit time is 200 g·mm/min was used and the measurement was carried out in the similar manner. In FIG. 6, (×) indicates the first example for comparison. With this condition, the amount of toner scattered was not less than 60 milligram (mg) and it crossed the tolerance level. Further, actual image forming was carried out and it was confirmed that there was a contamination in the unit and contamination of the surface of the medium.

Figure 7:
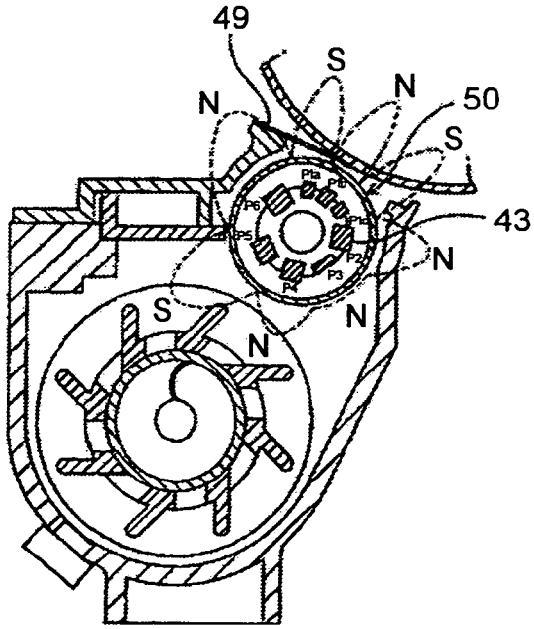
FIG. 7 is a schematic diagram of a developing device according to a modified example.

The following is a description of a modified example of a developing device and an experiment that was carried out by using a modified image forming apparatus. FIG. 7 is a schematic diagram of a developing device according to the modified example. A developing device 4 includes a developing sleeve 41. The developing sleeve 41 includes magnets 43 as a magnetic field generating unit. The magnets 43 have a peculiarity. The magnets 43 cause the developer on the developing sleeve 41 to erect in the developing region and have a decrement of the magnetic flux density in a normal direction of the main magnetic pole that forms the magnetic brush, not less than 40%. By having such a magnet, it is possible to make a nip of the magnetic brush that scrapes the photosensitive drum 1, shorter and toner is not drifted easily at the tip of the magnetic brush. By using such a magnetic brush, a white patch at an end caused by insufficient adhesion of toner can be reduced and the image quality can be improved. To make the decrement of the main magnetic pole not less than 40%, a three-pole structure with poles P1*a* (S pole), P1*b* (N pole), and P1*c* (S pole) is adopted for the main magnetic pole. Therefore, the magnets 43 includes the P1*a* (S pole), the P1*b* (N pole), the P1*c* (S pole), a P2 (N pole), a P3 (N pole), a P4 (N pole), P5 (S pole), and a P6 (N pole) in a direction of rotation from a portion opposite to the doctor 49. Due to accommodating of these magnetic poles, the developing sleeve 41 became bigger in size and its diameter ϕ became 30 mm.

An amount to be drawn by the doctor 49 was set to 60 mg/cm$^2$ and the linear velocity of the developing sleeve 41 was set to 380 mm/sec. The drawing width was let to be 320 mm and a paper of size A3 was allowed to be output. Due to an increase in the diameter of the developing sleeve 41, the length of the opening became 23 mm.

A developer similar to that in the first example for which the proportion WST [%] of the weakly charged toner is 2.3% was used. As the second example, in the developing device according to the modified example, developers with the concentration of toner 5% by mass and 7% by mass were used and the relationship between the amount of the weakly charged toner that passes through the opening per unit time and the amount of scatter of toner was examined and was shown in FIG. 6 with (●). As shown in FIG. 6, for both the densities 5% by mass and 7% by mass, the amount of the weakly charged toner passing through the opening per unit time was not more than 200 g·mm/min and the amount of toner scattered was not more than 60 mg. Actual image forming was carried out and it was confirmed that there was no contamination in the unit and no contamination of the surface of the medium.

Further, in a third example, when the density of the toner was adjusted to 8.5% by mass, the amount of toner charged oppositely that passes through the opening per unit time increased to 240 g·mm/min. The similar measurement was carried out by using this amount. In FIG. 6, (×) indicate the third example. With this condition, the amount of toner scattered was not less than 60 mg and it crossed the tolerance level. Further, actual image forming was carried out and it was confirmed that there was a contamination in the unit and contamination of the surface of the medium.

In this image forming apparatus, from a point of view of improvement in the transferring capability, if toner with an average circularity greater than 0.96 is used, the transfer of toner is stable and a uniform image can be achieved during the transfer. However, for toner with an average circularity greater than 0.96, the proportion WST [%] of the weakly charged toner measured by the E-SPART analyzer tended to increase and the scatter of toner was found to be worsened. Therefore, as shown in a third example, the area of the opening of the developing device 4 and the amount to be drawn etc. can be adjusted and the amount of the toner charged oppositely that passes through the opening per unit time can be reduced and the scatter of toner can be suppressed.

For the improvement in the transferring capability, toner that has an average circularity greater than 0.96 was used. In the developing device 4 according to the modified example, i.e. the second example, an inlet seal 48 made of a flexible material was provided on a further down-stream side of the doctor 49 in a direction of rotation of the developing sleeve 41 such that the inlet seal 48 covers the developer 47 and the length of the opening is adjusted to 17 mm. The doctor 49 was used such that the amount to be drawn was reduced to 60 mg/cm$^2$ and 40 mg/cm$^2$. The linear velocity of the developing sleeve 41 was let to be the same 380 mm/sec. With the developing device 4 having these adjustments, in the third example, the amount to be drawn was 40 mg/cm$^2$ and 60 mg/cm$^2$ respectively and the relationship between the weakly charged toner that passes through the opening per unit time and the amount of scattered toner was examined and shown in FIG. 6 with (□). As shown in FIG. 6, for both the amounts to be drawn 40 mg/cm$^2$ and 60 mg/cm$^2$, the amount of the weakly charged toner passing through the opening per unit time was not more than 200 g·mm/min and the amount of toner scattered was not more than 60 mg, which is a tolerable level. Actual image forming was carried out and it was confirmed that there was no contamination in the unit and no contamination of the surface of the medium.

In a fourth example for comparison, when a developer for which the amount to be drawn is 80 mg/cm$^2$ was used, the amount of toner charged oppositely that passes through the opening per unit time increased to 260 g·mm/min. Similar measurement was carried out by using this value. In FIG. 6, (×) indicates the fourth example for comparison. With this condition, the amount of toner scattered was not less than 60 mg and it crossed the tolerance level. Further, actual image forming was carried out and it was confirmed that there was a contamination in the unit and contamination of the surface of the medium.

From the results of the first, second and the third experiments, we can say that it was proved that, by controlling the amount of the toner charged oppositely that passes through the opening per unit time, to be not more than 200 g·mm/min, the amount of scatter of toner can be suppressed effectively.

According to the third experiment, we can say that it was proved that, even by using toner which has a higher proportion WST [%] of weakly charged toner to achieve a high quality of image, by adjusting the area of the opening, the amount to be drawn etc., it is possible to control the amount of the toner charged oppositely that passes through the opening per unit time and the amount of scatter of toner can be suppressed effectively.

The following is a description of developing conditions according the first embodiment.

In the developing device 4, a relationship of an electric potential VD in non-image portion of the photosensitive drum 1, an electric potential VL in latent image portion, an electric potential VB of a developing bias that is applied to the developing sleeve 41 is such that it fulfils the following equation A2.

$$0<|VD|-|VB|<|VD-VL|<250\ V \quad (A2)$$

This leads to a reduction in an amount of charge, reduction in fatigue of the photosensitive drum 1 due to repeated charging and exposing of the photosensitive drum 1, and an increase in the life of the photosensitive drum 1. In the first embodiment, the developing is performed with the values of the electric potential VD in non-image portion, the electric potential VL in latent image portion, and the electric potential VB of a developing bias, −350 V, −50 V, and −250 V respectively, i.e. the developing is performed with the developing potential of 200 V (VL−VB=200). However, with these developing conditions, since the difference between the VD and VB is small, the toner tends to get adhered on the surface and there tends to be a faulty image with contamination of surface of the image on the medium. Therefore, when these conditions are used, by controlling the amount of toner charged oppositely that passes through the opening per unit time to be not more than 200 g·mm/min, it is possible to control effectively an image with an excessive concentration of toner at certain locations due to the scatter of toner.

Moreover, when the minimum amount X of toner adhered that enables to achieve a saturated image density is defined by the following equation A3, the maximum amount of toner adhered on the photosensitive drum is controlled to be not more than 1.5×X.

$$X=0.6\times\text{particle size of toner}\times\text{true specific gravity of toner/transfer ratio} \quad (A3)$$

This is to prevent excessive adhesion of toner on the photosensitive drum 1 even when the image density is set to be higher than the saturated image density so that the maximum amount of toner adhered on the photosensitive drum 1 is not more than 1.5 times of the minimum amount of toner adhered that enables to achieve the saturated image density on the photosensitive drum 1.

When the particle size of toner is 6.8 μm, the true specific gravity of toner is 1.05 g/cm$^3$, the transfer ratio is 90%, and the amount required is 60%, then $X=6.8\times10^{-4}$ cm×1.05 g/cm$^3$/0.9×0.6=0.476 mg/cm$^2$ and 1.5×X=0.714 mg/cm$^2$.

Figure 9:
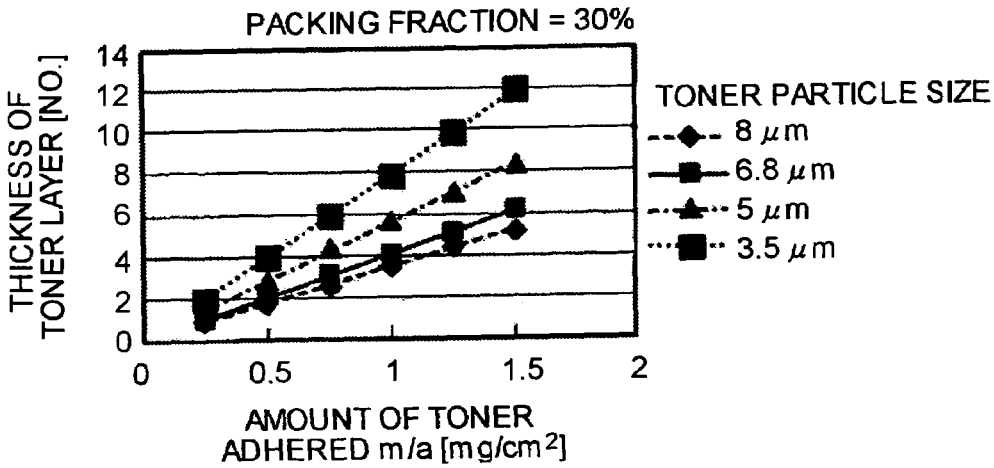
FIG. 9 is a graph of a relationship between a thickness of a toner layer and an amount of toner adhered with a particle size of toner as a parameter.
Figure 10:
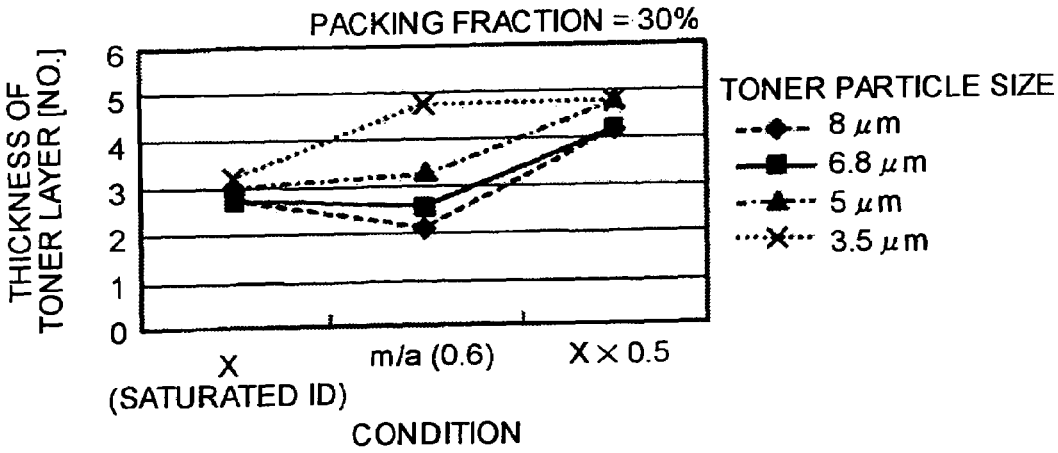
FIG. 10 is a graph of the thickness of a toner layer under conditions when an amount of toner adhered on a photosensitive drum 1 that is required for achieving a saturated image density ID is X, when an amount of toner adhered is 0.6 mg/cm$^2$, and when an amount of toner adhered is 1.5 times of X, with a toner particle size as a parameter.

FIG. 9 is a graph of a relationship between a thickness of toner layer and the amount of toner adhered (converted to toner count respectively) with the particle size of toner as a parameter. FIG. 10 is a graph of the thickness of toner layer under the conditions when the amount of toner adhered on the photosensitive drum that is required for achieving the saturated image density ID is X, when the amount of toner adhered is 0.6 mg/cm$^2$, and when the amount of toner adhered is 1.5 times of X (converted to toner count respectively), with a toner particle size as a parameter. In FIGS. 9 and 10, a packing fraction of toner is 30%. According to graphs in FIGS. 9 and 10, it can be seen that by setting the amount of toner adhered on the photosensitive drum to 1.5 times of X, the thickness of the toner layer becomes not more than five layers. If the thickness of the toner layer becomes not more than five layers, the electrostatic adhesion of toner is about 1/25 of one layer and can be held somehow. However, if the thickness of toner layer is more than five layers, for example if the thickness of toner layer is six layers, the electrostatic adhesion of toner is reduced to about 1/36 of one layer and causes scatter during transfer. Further, by adjusting the maximum amount of toner adhered to 0.6 mg/cm$^2$, as shown in FIG. 10, in which the thickness of toner layer when the maximum amount of toner adhered 0.6 mg/cm$^2$ is shown, since it is not more than five layers, no scatter is caused during the transfer.

When an AC is superimposed on the developing bias VB with the conditions mentioned above, the toner tends to move easily from the magnetic brush and there is an increase in the scatter of toner. When the AC was superimposed on the developing bias VB with the developer in the first example for comparison in the first experiment, as shown in the second example for comparison, there was a further increase in the scatter of toner and contamination in the unit and contamination of the surface of the medium, both the contaminations being conspicuous. Therefore, to suppress the scatter of toner, it is desirable that the developing bias does not include an AC component.

Figure 8:
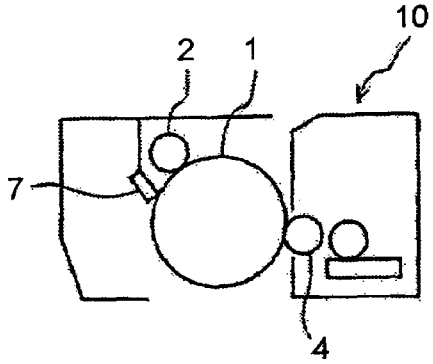
FIG. 8 is an example of a structure of a process cartridge.

In the image forming apparatuses according to the embodiments mentioned so far, the photosensitive drum 1 and the developing device 4 may be structured as one integrated unit and a process cartridge 10 that is detachable from the image forming apparatus may be provided. FIG. 8 is an example of a structure of the process cartridge 10 in which, in addition to the photosensitive drum 1 and the developing device 4, a charging unit 2 and a cleaning unit 6 are integrated to form a process cartridge 10. Such a type of an integrated process cartridge enables to suppress the contamination in the unit due to the scatter of toner from the opening which is disposed opposite to the photosensitive drum 1 of the developing device 4. The process cartridge 10 is not limited to this integrated unit, and can be structured by selecting and adding other image forming units voluntarily to the photosensitive drum 1 and the developing device 4 to form an integrated unit.

Thus, according to the image forming apparatus in the first embodiment, by regulating the amount of weakly charged toner that passes through the opening per unit time, it is possible to control an image with excessive concentration of toner at certain locations due to the scatter of toner. This is effective particularly in a high-speed image forming apparatus with the linear velocity 9000 mm/min of the developing sleeve 41.

Further it is desirable that the developing bias that is applied to the developing sleeve 41 does not include an AC component. This is because, if the developing bias VB includes an AC component, the toner tends to move easily from the magnetic brush thereby causing an increase in the amount of scatter of toner.

Moreover, the decrement of the magnetic flux density in the normal direction of the developing magnetic pole that forms the magnetic brush by causing to erect the two-component developer 47 of the developing sleeve 41 in the opening 50, among the magnets in the developing sleeve 41, is let to be not less than 40%. This enables to make the nip of the magnetic brush that scrapes the photosensitive drum 1, shorter and the toner cannot be drifted easily at the tip of the magnetic-brush. By using such a magnetic brush, a white patch at the end caused by insufficient adhesion of toner can be reduced. As a result, it is possible to suppress the scatter of toner as well as to improve the image quality.

The developing is performed by moving the magnetic brush of the developing device 4 in a direction same as that of the movement of the photosensitive drum 1 with a speed faster than that of the photosensitive drum 1 and while allowing contact with the surface of the photosensitive drum 1. The developing by moving the magnetic brush at a speed faster than that of the photosensitive drum 1 ensures the desired image density and by allowing to move while making contact with the surface of the photosensitive drum 1, the scatter of toner can be reduced as compared to a case in which the magnetic brush is not in contact with the surface of the photosensitive drum 1.

If VD is an electric potential of dark portion of the photosensitive drum 1, VL is an electric potential after exposure, and VB is a developing bias voltage that is applied on the photosensitive drum 1, a relationship of these three fulfils the equation:

$$0<|VD|-|VB|<|VD-VL|<250\ V.$$

Moreover, if the minimum amount of toner adhered that enables to achieve the saturated image density is X, the maximum amount of toner adhered on the photosensitive drum 1 is controlled to be not more than 1.5×X. In this case, the minimum amount of toner adhered X is an amount of toner in which there is at least 60% of toner in a space that is equivalent to the thickness by the particle size of toner and X is expressed by X=particle size×true specific gravity/transfer ratio×0.6. By adopting such conditions, there is a reduction in the amount of charge, reduction in fatigue of the photosensitive drum due to repeated charging and exposing of the photosensitive drum 1, and an increase in the life of the photosensitive drum 1. However, with these developing conditions, since the difference between VD and VB is small, the toner tends to get adhered on the surface and there tends to be a faulty image with contamination of the surface of the medium. Therefore, when these conditions are used, by controlling the amount of toner charged oppositely that passes through the opening per unit time to be not more than 200 g·mm/min, it is possible to control effectively an image with an excessive concentration of toner at certain locations due to the scatter of toner. Further, since the maximum amount of toner adhered on the photosensitive drum 1 is not more than 1.5 times of the minimum amount of toner adhered that enables to achieve the saturated image density on the photosensitive drum 1, even when the image density is set to be higher than the saturated image density, measures are taken to prevent the excessive adhesion of toner on the photosensitive drum 1.

If the amount of toner adhered on the photosensitive drum 1 is let to be more than this, there is a decrease in the electrostatic adhesion of the toner 46 to the photosensitive drum 1 which causes scatter during transfer, thereby deteriorating the image quality. For this, the amount of toner adhered on the photosensitive drum 1 is controlled and a high quality image without scatter of toner is achieved.

Toner that has an average circularity greater than 0.96 is to be used as toner 46. For the improvement in the transferring capability, if the toner that has an average circularity greater than 0.96 is used, the transfer of toner is stable and uniform image can be achieved during the transfer. However, for toner with an average circularity greater than 0.96, the proportion WST [%] of the weakly charged toner measured by the E-SPART analyzer tended to increase and the scatter of toner was found to be worsened. In such case, the area of opening on the developing device 4 side and the amount to be drawn etc., can be adjusted and the amount of the toner charged oppositely that passes through the opening per unit time can be reduced and the scatter of toner can be suppressed, thereby achieving the both.

Moreover, the photosensitive drum 1 and the developing device 4 may be integrated and the process cartridge 10 may be structured such that it is detachable from the image forming apparatus. By structuring such a process cartridge 10, it is possible to suppress the contamination in the unit due to the scatter of toner.

A schematic structure and an operation of a printer according to a second embodiment are described below.

Figure 12:
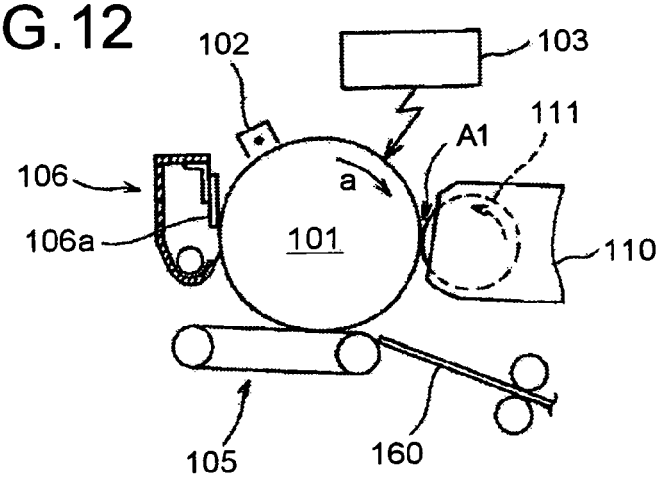
FIG. 12 is a schematic diagram of the printer.

FIG. 12 is a schematic diagram of a printer according to the second embodiment. The printer includes a photosensitive drum 1 which is a latent image carrying unit that rotates in a direction of an arrow, around which a charging unit 102, an exposing unit 103, a developing device 110, a transferring device 105, and a cleaning 106 etc. are disposed. The charging unit 102 charges uniformly a surface of the photosensitive drum 101. The exposing unit 103 irradiates laser beam that is modulated based on image information, on the photosensitive drum 101 which is charged uniformly. The developing device 110 is a two-component developer developing device that uses a developer which includes toner and a magnetic carrier as a toner carrier. The developing device 110 carries a developer in the form of a brush that is held on the developing roller 111 as a developer carrying unit which is a surface conveyor to a developing region A1 which is opposite to the photosensitive drum 101. A toner image is formed by causing charged toner in the developer that is held on the developing roller 111 to adhere on an electrostatic latent image which is formed on the photosensitive drum 101. The transferring device 105 transfers the toner image formed on the photosensitive drum 101 to a transfer paper 160 which is a material for transfer. The cleaning unit 106 includes a cleaning blade 106*a* as a cleaning member, which removes toner remained on the photosensitive drum after transferring of the image.

Moreover, the printer according to the second embodiment includes a paper feeding unit and a fixing unit which are not shown in the diagram. The paper feeding unit feeds a transfer paper from a feeding tray that is not shown in the diagram and the transferring device fixes the toner image transferred by the transferring device 105, to the transfer paper 160. A part of a plurality of units in the printer may be structured as a process cartridge which is an integrated unit detachable from the printer.

Figure 13:
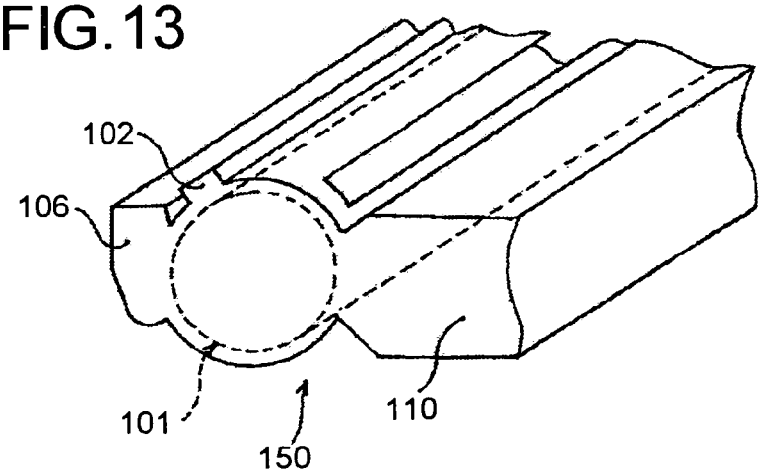
FIG. 13 is a partial perspective view of a process cartridge that can be used in the printer.
Figure 14:
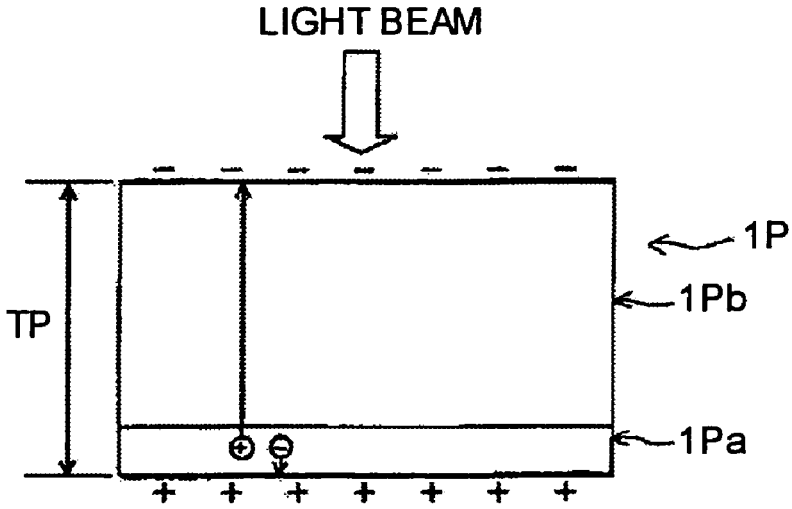
FIG. 14 is a cross-sectional diagram of a photosensitive layer of a photosensitive drum.

FIG. 13 is an illustration of a process cartridge 150 that is formed as an integrated unit detachable from the printer in which the photosensitive drum 1, the charging unit 102, the developing device 110, and the cleaning unit 106 are integrated. By forming the process cartridge 150 as an integrated unit detachable from the printer, maintenance and replacement of image forming units such as the photosensitive drum 101 etc. is facilitated.

A structure of each component of the printer according to the second embodiment is described below in detail.

The photosensitive drum 101 includes an electro conductive substrate (such as a pipe of aluminum etc.) that is grounded and on which a photosensitive layer is formed by applying an inorganic or organic photosensitive material. The photosensitive layer includes an electric charge generating layer 1Pa and an electric charge transporting layer 1Pb. A surface of the photosensitive layer is charged uniformly to negative polarity by the charging unit.

A photosensitive belt in which the photosensitive layer is formed on a comparatively thin polyethylene terephthalate (PET), polyethylene naphthalate (PEN), nickel etc. can also be used as a latent image carrying unit. The photosensitive drum 101 which is charged uniformly to negative polarity is used in the second embodiment. However, a photosensitive drum that is charged to positive polarity according to the requirement by taking into consideration relationship with the charging polarity of toner may also be used.

Figure 11:
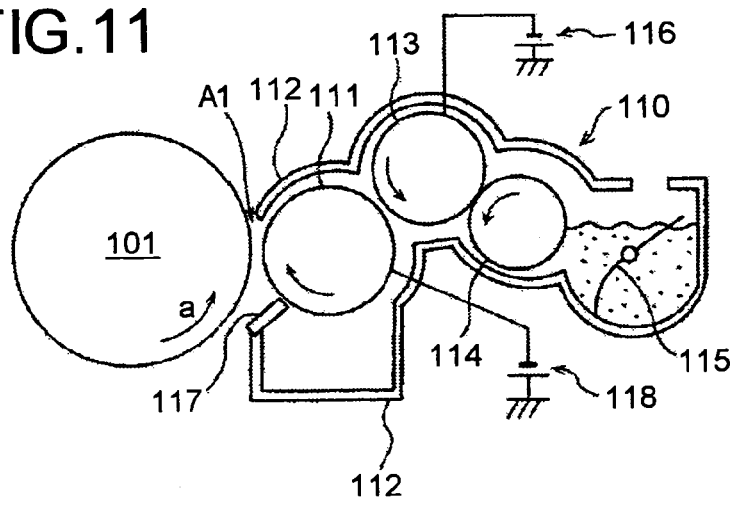
FIG. 11 is a schematic diagram of a developing device installed in a printer according to a second embodiment.

FIG. 11 is a schematic diagram of the developing device 110.

The developing device 110 includes a casing 112 and a developing roller 111. The developing roller 111 is provided such that a part of the developing roller 111 is exposed from an opening of the casing 112. The developing roller 111 includes a non-magnetic developing sleeve and a magnet roller that is not shown in the diagram. The developing sleeve is in the form of a hollow circular cylinder that can rotate and the magnet roller is an electric field generating unit which is fixed inside the developing sleeve. It is desirable that a diameter of the developing roller 111 is in a range of 10 mm to 30 mm and a surface of the developing sleeve is subjected to a process in which a plurality of grooves of depth from one mm to few mm is formed such that the roughness of the surface Rz (an average of roughness at ten points) is in a range of 10 μm to 20 μm. The magnet roller has four magnetic poles N pole, S pole, N pole, and S pole in a direction of rotation of the developing roller from a position of regulated thickness i.e. doctor 117. However, the arrangement of the magnetic poles of the magnet roller is not limited to this and the magnetic poles may also be arranged according to a position of the doctor 117 around the developing roller 111.

Due to a magnetic field generated by the magnet roller, a magnetic carrier is held on the surface of the developing roller 111 and toner is adhered on the magnetic carrier. The thickness of a layer of the developer thus held on the developing roller 111 is regulated by the doctor 117 which is a layer-thickness regulator, so that the toner is not charged much. Due to this, a fixed amount of the developer is held on the developing roller 111 and carried to a developing region A1 and the developer that is left after being regulated by the doctor 117 is returned to the casing 112. According to the second embodiment, a distance between the doctor 117 and the developing roller 111 when they are close to each other is set to 500 μm and the magnetic pole of the magnet roller opposite to the doctor 117 is disposed in a position inclined by few degrees in an upstream side of a position opposite to the doctor 117 in a direction of movement of the surface of the developing roller 111. Due to this, a circulation flow of the developer in the casing 112 can be formed easily. A desirable range of an angle of inclination of the magnetic pole is 0° to 15°.

Toner in the developer that is carried to the developing region A1 is transferred to an electrostatic latent image that is formed on the surface of the photosensitive drum 101 due to a developing magnetic field which is formed between the developing roller 111 and the photosensitive drum 101 and the electrostatic latent image is developed. The developing magnetic field is formed by applying voltage to the developing roller 111 from a power supply 118. Further, the developer remained after consumption of toner in the developer in the developing region A1 returns to the casing with the rotation of the developing roller 111.

According to the second embodiment, the diameter of the photosensitive drum 101 is set to 50 mm, the linear velocity of the photosensitive drum 101 is set to 200 mm/s, the diameter of the developing roller 111 is set to 18 mm, and the linear velocity of the developing roller 111 is set to 240 mm/s. An amount of electric charge on the developing roller 111 is in a range of −10 μC/g to −30 μC/g. A developing gap which is a distance between the photosensitive drum 101 and the developing roller 111 is set in a range of 0.8 mm to 0.4 mm. Thus, by reducing the developing gap as compared to that in the conventional unit, the developing efficiency is improved.

According to the second embodiment, the toner in the developer contains a resin such as polyester, polyol, styrene acrylic etc. with a charge controlling agent (CCA) and a coloring material mixed in it and an additive such as silica and titanium oxide added around it to improve the fluidity. The particle size of the additive is in a range of 0.1 μm to 1.5 μm. Carbon black, phthalocyanine blue, quinacridone, carmine etc. are examples of the coloring material. Toner in which the additive is added externally to host toner in which wax etc. is mixed by dispersion can also be used.

By including a magnetic material in the toner, the toner can be used as magnetic toner. The concrete examples of the magnetic material are, iron oxides such as magnetite, hematite, ferrite, metals such as cobalt and nickel or alloys or compounds of metals such as cobalt and nickel with a metal such as aluminum, copper, lead, magnesium, tin, zinc, antimony, beryllium, bismuth, cadmium, calcium, manganese, selenium, titanium, tungsten, vanadium etc. The desirable average particle size of the magnetic material to be included is in a range of 20 parts by mass to 200 parts by mass with respect to 100 parts by mass of a binder resin and the more desirable amount of the magnetic material is in a range of 40 parts by mass to 150 parts by mass with respect to 100 parts by mass of a binder resin.

Additives which have been known conventionally can be used. Concretely, the examples of additives are oxides and complex oxides of Si, Ti, Al, Mg, Ca, Sr, Ba, In, Ga, Ni, Mn, W, Fe, Co, Zn, Cr, Mo, Cu, Ag, V, and Zr. In particular, silica, titania, and alumina which are oxides of Si, Ti, and Al are desirable as an additive. The desirable amount of additive is 0.5 parts by mass to 3 parts by mass with respect to 100 parts by mass of a host particle and an amount of 0.7 parts by mass to 1.5 parts by mass is more desirable. If the amount of the additive is less than 0.5 parts by mass, the fluidity of the toner is deteriorated resulting in insufficient charging. Also there is insufficient transferring, and insufficient heat conserving resistance, which cause contamination of surface of the image on the medium and scatter of toner. On the other hand, if the amount of additive is more than 1.8 parts by mass, the fluidity is improved on one hand whereas due to chattering and rolling of a blade, there tends to be improper cleaning of the photosensitive drum 101 and filming of additive that is separated apart from the toner on the photosensitive drum 101. This results in the deterioration of durability of the cleaning blade and the photosensitive drum 101 and the deterioration of fixing. Further, the toner tends to scatter in a thin line portion, particularly in a case of an output of thin line in a full-color image, due to a need to superimpose at least two colors, the scatter in a thin line portion tends to be conspicuous with an increase in the amount adhered. In a case of a color toner, if there is an excessive amount of an additive, when a toner image formed on a transparent sheet is projected by an overhead projector, there is a shadow in a projected image, and it is difficult to achieve a clear projected image.

There are various methods for measurement of an amount of additive, and a fluorescent X-ray spectroscopy is used in general for the measurement. In this method, for a toner for which the additive content is already known, a calibration curve is prepared by a fluorescent X-ray spectroscopy and the additive content is calculated by using the calibration curve.

It is desirable that the additive used in the second embodiment is subjected to a surface treatment to have hydrophobicity, improved fluidity, and charging control according to the requirement. Compounds of organic silane are desirable to be used as a treatment agent for the surface treatment and the examples of the compounds of organic silane are alkylchlorosilanes such as methyltrichlorosilane, octyltrichlorosilane, dimethyldichlorosilane, alkylmethoxysilanes such as dimethyldimethoxysilane and octyltrimethoxysilane, Hexanedimethyldisilazane, and silicone oil. A method in which an additive soaked in a solution that contains the compound of organic silane, and then dried and a method in which a solution containing the compound of organic silane is sprayed on an additive and then dried are methods for the surface treatment and in the second embodiment whichever of the two methods is suitable, can be used. It is desirable that the volume average particle size of the toner is in a range of 3 μm to 12 μm. The volume average particle size of the toner used in the second embodiment is 6 μm and this toner can cope sufficiently with an image of high resolution of not less than 1200 dpi. Further, in the second embodiment, toner which has a negative polarity of charging is used and toner with a positive polarity of charging can also be used according to the polarity of charging of the photosensitive drum 101.

According to the second embodiment, the magnetic carrier in the developer includes a core of a metal or a resin which has a magnetic material such as ferrite inside and an outer layer of the core is coated with a silicon resin. It is desirable that the volume average particle size of the magnetic carrier is in a range of 20 μm to 50 μm and the electrical resistance of the magnetic carrier which is a dynamic resistance DR, is in a range of $1\times10^2$ ohms (Ω) to $1\times10^{11}$ Ω. If the electrical resistance is greater than $1\times10^{11}$Ω, a surface of the magnetic carrier is charged and no sufficient toner is supplied even if an existing supply bias is applied.

Figure 15:
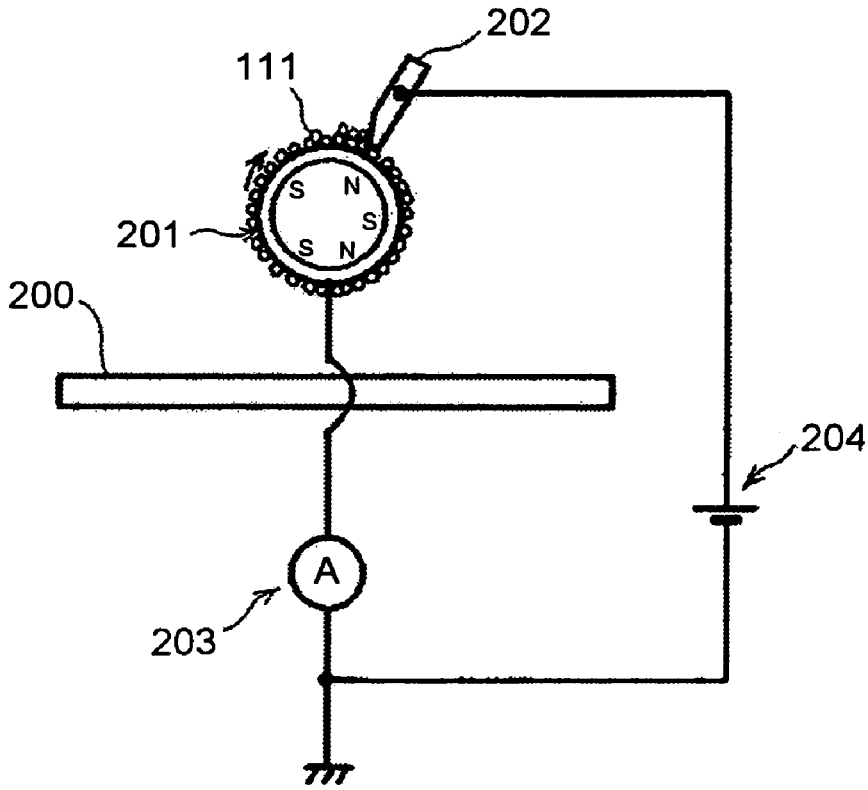
FIG. 15 is an illustration of a unit for measurement of dynamic resistance DR.

The dynamic resistance DR of the magnetic carrier was measured by using a measuring instrument shown in FIG. 15 by the following method. To start with, a sleeve 201 that can be rotated is set on an upper side of a seating 201. The sleeve has a diameter ϕ 20 mm and has inbuilt magnets fixed in predetermined positions. A counter electrode (doctor) 202 is allowed to face a surface of the sleeve 201 at a distance g=0.9 mm from the sleeve 201. The counter electrode 202 has a width W=65 mm and length L=0.5 mm to 1 mm. The sleeve 201 is rotated at a speed of 600 rotations per minute (rpm) (linear velocity of 628 mm/sec). A predetermined amount (14 g) of the magnetic carrier subjected to the measurement of the dynamic resistance is placed on the rotating sleeve 201 and the magnetic carrier is stirred for 10 minutes by rotations of the sleeve 201. Current I off amperes (A) that flows between the sleeve 201 and the counter electrode 202 when no voltage is applied to the sleeve 201 is measured by an ammeter 203. Further, voltage E of upper limit level of withstanding voltage (voltage from 400 volts in a high resistance silicon coated magnetic carrier to few volts in iron powder magnetic carrier) is applied for five minutes from a DC power supply 204 to the sleeve 201. According to the second embodiment, voltage of 200 V was applied. Current I on A that flows between the sleeve 201 and the counter electrode 202 when the voltage E is applied, is measured by the ammeter 203. From the results of the measurements, the dynamic resistance DR Ω is calculated by using the following equation B1

$$DR=E/(I\ \text{on}-I\ \text{off}) \quad \text{(B1)}$$

The developing device 110 includes a replenishing unit for replenishment of new toner (hereinafter, "toner for replenishment") to the developer on the developing roller that has consumed the toner in the developing region A1. The replenishing unit includes a supplying roller 113, a replenishing roller 114, and an agitator 115. The toner for replenishment that is stored in the storage for the toner for replenishment storage is carried near the replenishing roller 114 by the agitator 115. The replenishing roller 114 is made flexible by foamed polyurethane due to its porous nature. Toner for replenishment that has come in contact with the replenishing roller 114 is held on an outer surface or in a slightly penetrated region of the replenishing roller 114 and is carried with the rotation of the replenishing roller 114. The toner for replenishment that is carried by the replenishing roller 114 up to a region opposite to the supplying roller 113 is rubbed between the replenishing roller 114 and an outer surface of the supplying roller 113 and causes frictional charging, thereby charged to a predetermined polarity and adhered on the outer surface of the supplying roller 113. The supplying roller 113 that carries the charged toner for replenishment carries it up to a region opposite to the developing roller 111.

At this time, the amount of charge on the toner is in a range of −10 μC/g to −35 μC/g. An amount of toner adhered per unit area of the supplying roller 113 is in a range of 0.3 mg/cm$^2$ to 1 mg/cm$^2$.

A power supply 116 applies predetermined voltage to the supplying roller 113. The voltage applied to the supplying roller 113 is voltage of negative polarity less than the voltage (voltage of negative polarity) applied to the developing roller 111, i.e. voltage of negative polarity that has an absolute value greater than the voltage applied to the developing roller 111. Due to this, an electric field from the developing roller 111 towards the supplying roller 113 is formed in a region opposite to the supplying roller 113 and the developing roller 111. According to the second embodiment, since toner that is charged to negative polarity is used, the toner for replenishment in a region opposite moves from the supplying roller 113 to the developing roller 111. The developer from which the toner is consumed in the developing region is carried to the area opposite which is between the supplying roller 113 and the developing roller 111. Due to this, the toner for replenishment on the supplying roller moves towards the developing roller 111 because of an effect of the electric field and is adhered electrostatically on the magnetic carrier in the developer. According to the second embodiment, a toner-amount adjusting unit includes the developing roller 111, the supplying roller 113, the power supply 116, and the power supply 118.

Figure 16:
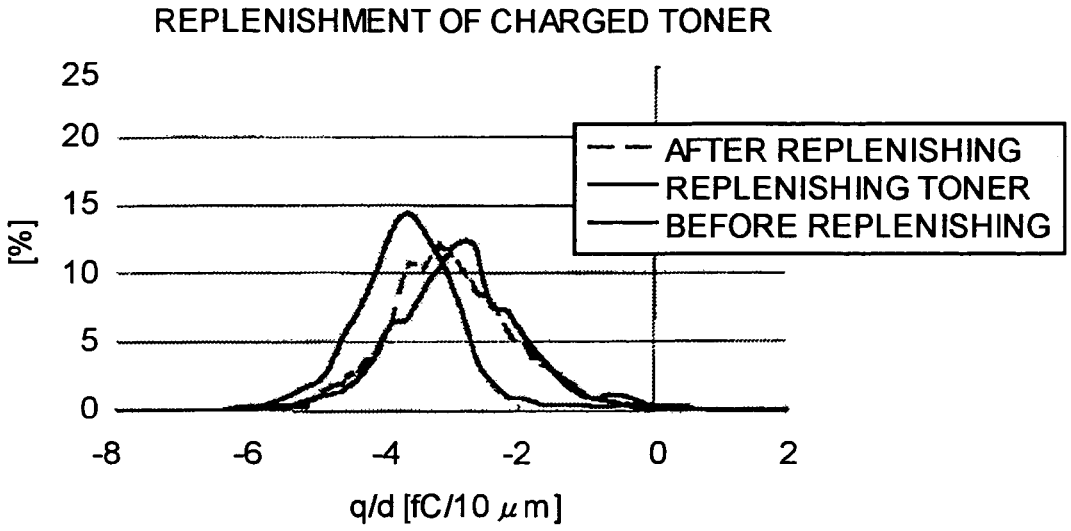
FIG. 16 is a graph of an electric charge distribution of a toner in a printer.
Figure 17:
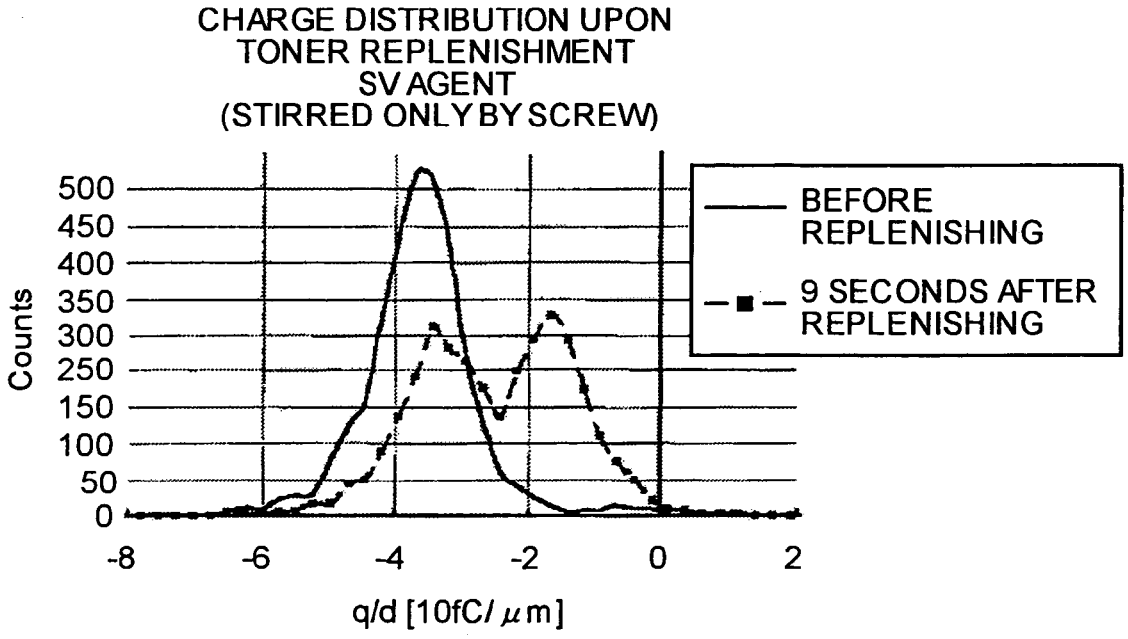
FIG. 17 is a graph of an electric charge distribution after toner for replenishment that is not charged and stirred for a fixed period of time (one minute) in the developing device.

FIG. 16 is a graph of an electric charge distribution of toner in the printer according to the second embodiment. FIG. 17 is a graph of an electric charge distribution after toner for replenishment that is not charged and stirred for a fixed period of time (one minute) in the developing device. The graphs shown in FIG. 16 indicates an electric charge distribution in the developer before the developer is replenished with the toner for replenishment, an electric charge distribution of the toner for replenishment with which the developer is replenished, and an electric charge distribution in the developer after the developer is replenished with the toner for replenishment.

The inventors of the present invention, upon measuring the amount of electric charge on the magnetic carrier and the toner for 2 g developer that is carried to the developing region confirmed that the electric charge on the magnetic carrier was 26.5 μC/g and the electric charge on the toner was −25.2 μC/g.

The E-SPART analyzer (manufactured by HOSOKAWA MICRON COMPANY INC.) was used. This E-SPART analyzer employs a method in which a double beam, frequency shift type of laser Doppler speedometer and an acoustic wave that causes the motion of particles to perturb in a static electric field, are used. By employing this method, air is blown on the developer on the developing roller 111 and the motion in the electric field is detected thereby acquiring data of the amount of charge on the toner and the magnetic carrier.

Thus, as in the second embodiment, with a structure in which the electric field is formed between the developing roller 111 and the supplying roller 113, and the developer is replenished with the toner for replenishment due to the effect of the electric field, it is possible to control the amount of the toner that can be held by the magnetic carrier which is included in the developer before being replenished with the toner for replenishment. Concretely, the amount of the toner held on the magnetic carrier can be adjusted such that the total amount of the electric charge on the toner is not greater than the total amount of the electric charge on the magnetic carrier that carries the toner. If toner for which, the total amount of the electric charge on the toner is greater than the total amount of the electric charge on the magnetic carrier is held on the magnetic carrier and carried to the developing region, there is a contamination of the surface of the medium even if the toner is sufficiently charged.

Further, more is the quantity of the toner that is adhered on the surface of the developing roller 111, the apparent resistance of the surface of the developing roller 111 increases. Since the voltage is applied to the core of the developing roller 111, if the apparent resistance of the surface of the developing roller 111 increases, the developing bias between the surface of the developing roller 111 and the surface of the photosensitive drum 101 decreases and there tend to be the scatter of the toner.

For this reason, the inventors of the present invention changed the conditions for replenishing with the toner for replenishment and carried out an experiment to examine a relationship between ratio of the total amount of electric charge on the, magnetic carrier to the total amount of electric charge on the toner with the scatter of toner. A developer in which the particle size of the magnetic carrier is 50 μm and that of the toner is 6.9 μm was used.

Figure 18:
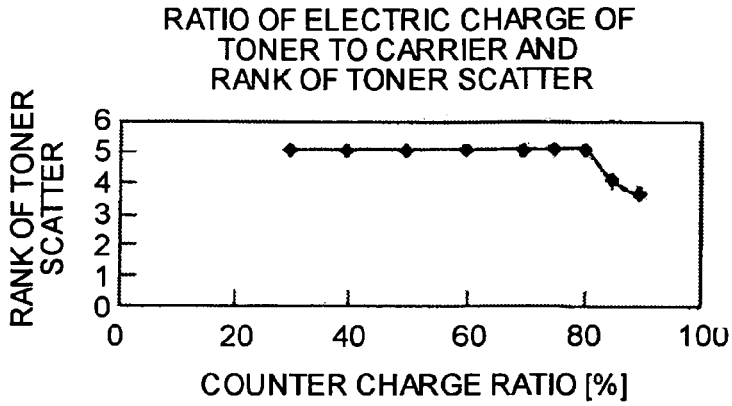
FIG. 18 is a graph of results of an experiment for examining a relationship between a proportion of a total amount of electric charge of a toner with respect to a total amount of electric charge of a magnetic carrier and scatter of the toner.

FIG. 18 is a graph in which the results of the experiment are shown. As it can be seen from the graph, if the ratio of the total amount of electric charge on the magnetic carrier to the total amount of electric charge on the toner is greater than 80%, the rank of the scatter of toner was found to be lowered. Lower is the rank of the scatter of toner, it indicates that greater is the quantity of toner scattered. On the other hand, if the ratio is not greater than 80%, the rank of the scatter of toner is maintained to be high and the quantity of toner scattered is very small. Therefore, according to the second embodiment, by adjusting the conditions for replenishing with the toner for replenishment, i.e. in concrete terms, by adjusting the number of rotations per minute of the supplying roller 113, the strength of the electric field between the supplying roller 113 and the developing roller 111, the control is carried out such that the ratio is not greater than 80%.

Further, for reference, the coverage Tn of the toner with respect to the magnetic carrier is a function of the density TC of the toner with respect to the density and is calculated by the following equation B2. In equation B2, C denotes the density TC [% by mass] of the toner, r denotes radius of a toner particle, R denotes radius of a magnetic carrier particle, ρr denotes true specific gravity of the toner, and ρt denotes true specific gravity of the magnetic carrier.

$$Tn = \frac{100C \cdot \sqrt{3}}{20\pi(100 - C)(1 + r/R)^2 (r/R)(\rho_r/\rho_t)} \quad \text{(B2)}$$

Another embodiment (hereinafter, "third embodiment") in which the present invention is applied to a similar printer as in the second embodiment is described below.

Since the basic structure and operation of the printer according to the third embodiment are similar to the basic structure and operation of the printer according to the second embodiment, the same reference numerals as in FIG. 11 are used for the same components.

Figure 19:
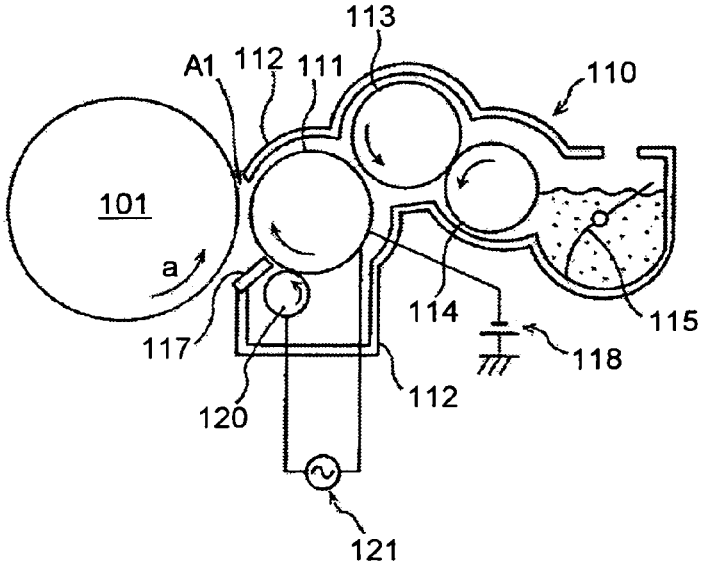
FIG. 19 is a schematic diagram of a developing device according to a third embodiment.

FIG. 19 is a schematic diagram of the developing device 110 according to the third embodiment. The basic structure and operation are similar to the basic structure and operation of the developing device 110 according to the second embodiment shown in FIG. 11. However, according to the third embodiment, the developer on the developing roller 111 is replenished with the toner for replenishment from the supplying roller 113 without forming the electric field between the supplying roller 113 and the developing roller 111. For this reason, an amount of toner for which the total amount of electric charge on the toner is greater than the total amount of electric charge on the magnetic carrier, is sometimes held by the magnetic carrier. Developer in which the toner of such an amount is held on the magnetic carrier is carried by the developing roller 111 to a region opposite to an electrode roller 120 which is a voltage applying member. The electrode roller 120 is disposed such that the minimum distance between the electrode roller 120 and the developing roller 111 is 500 μm. Further, an AC voltage is applied between the electrode roller 120 and the developing roller 111.

The toner and the magnetic carrier in the developer are charged to a polarity opposite to each other. Therefore, if an AC electric field is formed in the region opposite to the developing roller 111 and the electrode roller 120, in the AC electric field, the toner and the magnetic carrier move in directions opposite to each other according to the electric field and vibrate. Due to such vibrations, toner for which the electrostatic adhesion acting between the toner and the magnetic carrier is weak is shaken off. As a result, the amount of toner that is held by the magnetic carrier can be adjusted so that the total amount of electric charge on the toner is not greater than the total amount of electric charge on the magnetic carrier that carries the toner.

The developer before being replenished with the toner for replenishment may have concentration of toner affected due to the consumption of toner during the previous developing operation. In such a case, even if the toner for replenishment is supplied uniformly to such a developer, the affected density of the toner continues to be the same and the developer is carried once again to the developing region and contributes to developing.

This results in an image with a difference in the image density (image with unevenness).

Therefore, the inventors of the present invention carried out an experiment to examine a relationship with peak-to-peak voltage Vpp upon ranking the difference in the image density of a right portion and a left portion in an image when a sine wave of frequency 2 k [Hz] is applied.

Figure 20:
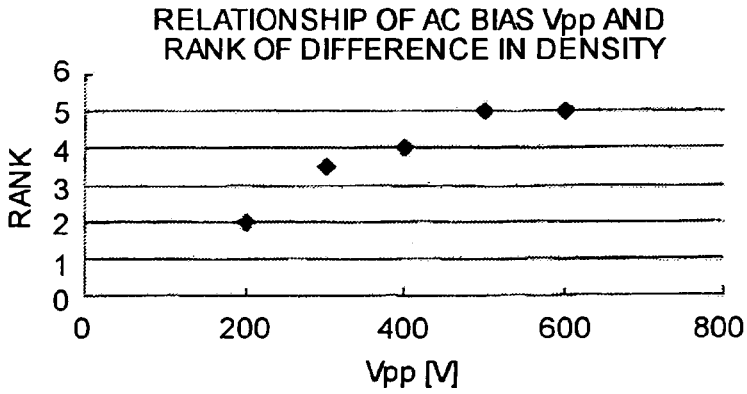
FIG. 20 is a graph of results of an experiment for examining a relationship of a difference in image densities of a right portion and a left portion when an alternating current (AC) electric field is formed, with peak-to-peak voltage.
Figure 21:
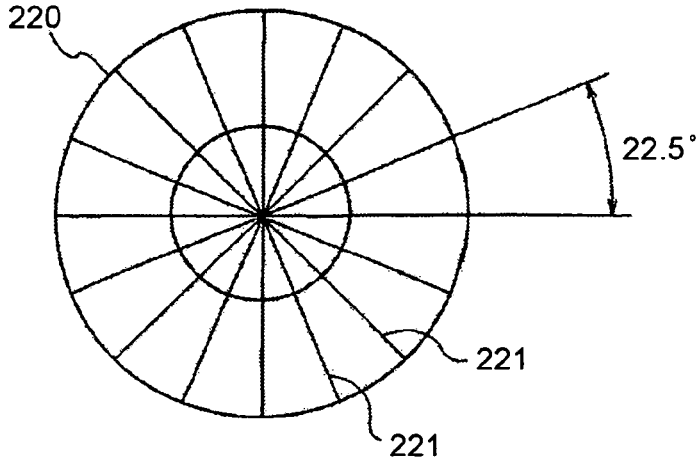
FIG. 21 is a schematic diagram of a stirrer for stirring a developer.

FIG. 20 is a graph of results of the experiment that was carried out.

The difference of less than 0.02 in the image densities was ranked as the fifth rank; the difference of less than 0.04 in the image densities was ranked as the fourth rank; the difference of less than 0.06 in the image densities was ranked as the third rank; the difference of less than 0.07 in the image densities was ranked as the second rank; and the difference of not less than 0.07 in the image densities was ranked as the first rank. It is desirable that the peak-to-peak voltage Vpp of the AC voltage is in a range of 100 V to 500 V and the frequency is in a range of 0.5 kHz to 8 kHz. Further, as seen in the graph shown in FIG. 20, it was found that if the peak-to-peak voltage Vpp is not less than 500 V, the fifth rank can be maintained. It is desirable that the wave form is any one of a rectangular waveform, a sine waveform, and a saw-tooth waveform. Moreover, DC voltage is not required to be superimposed and an alternating electric field is desirable.

Thus, the toner and the magnetic carrier in the developer move in the AC electric field as during vibrating, in the directions opposite to each other according to the electric field. Due to this the toner and the magnetic carrier in the developer can be mixed uniformly. If the peak-to-peak voltage is not less than 500 V, the toner and the magnetic carrier can be caused to be moved actively. As a result, even if the developer before being replenished with the toner for replenishment has the concentration of toner affected due to the consumption of toner during the previous developing operation, after the density of the toner is made uniform due to the AC electric field, since the developer is carried to the developing region, the difference in the densities in the image can be reduced.

According to the third embodiment, by causing the toner and the magnetic carrier to vibrate by forming the AC electric field, the toner for which the electrostatic adhesion acting between the toner and the magnetic carrier is weak is shaken off and the amount of toner that is held by the magnetic carrier is adjusted. However, the toner may also be shaken off from the magnetic carrier by other method. For example, without applying the AC electric field between the electrode roller 120 and the developing roller 111, the toner can be shaken off from the magnetic carrier by a mechanical stirring effect by using a stirrer instead of the electrode roller 120 and the amount of toner held by the magnetic carrier can be adjusted such that the total amount of electric charge on the toner is not greater than the total amount of electric charge on the magnetic carrier that carries the toner. A stirrer 220 shown in FIG. 22 can be used for stirring. The stirrer 220 includes 16 impeller blades 221 separated into 16 sections, each section with an angle 22.5° and rotates in a counter direction of that of the surface of the developing roller 111.

Further, the inventors of the present invention carried out an experiment to examine a relationship between the ratio of linear velocity of the surface of the developing roller to linear velocity of a surface of the stirrer 220 and the difference between the densities of image on the right-side portion and the left-side portion.

Figure 22:
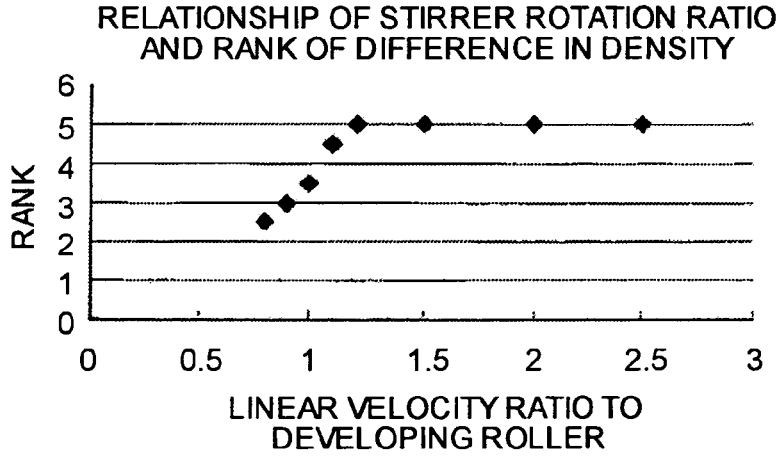
FIG. 22 is a graph of results of an experiment for examining a relationship between a proportion of a surface linear velocity of the stirrer with respect to a surface linear velocity of a developing roller and the difference in image densities.

FIG. 22 is a graph of the results of the experiment carried out. Regarding the ranks of the difference between the densities of image, the description is same as mentioned earlier. From the graph, it was found that if the ratio of the linear velocity of the developing roller 111 to that of the stirrer 220 is 1.2, the fifth rank can be maintained. This can be considered as a result of a sufficient stirring of the toner and the magnetic carrier in the developer. Moreover, it was found that if the ratio of the linear velocitys is not greater than 1.1, as the ratio of the linear velocitys goes on decreasing, the rank tends to be lower and the stirring by the stirrer 220 is less effective.

It is desirable that the toner used according to the third embodiment has a shape close to the spherical shape and the circularity of the toner is not less than 0.96. Such toner can be prepared by a method in which, polyester that is modified by the so called polymerization or urea bonding is caused to be included at least as a toner binder. On the other, toner prepared by a method such as grinding that have been used conventionally, has a low circularity due to random unevenness on the surface. It is difficult to achieve uniform developing features and there tend to be a difference in the densities of image. Taking this into consideration, if the circularity of toner is not less than 0.96, shape of each toner particle is close to the spherical shape and the surface is smooth with less unevenness. This enables to achieve uniform developing features and the difference in the densities of image is less.

The inventors of the present invention carried out an experiment to examine a relationship of a circularity with the difference in densities of the right-side portion and the left-side portion in an image by using six toners, each having different circularity.

Figure 23:
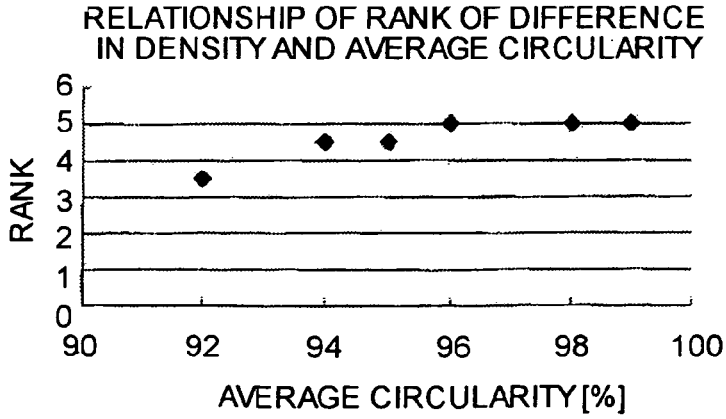
FIG. 23 is a graph of results of an experiment for examining a relationship between the right portion and the left portion in an image and the difference in image densities, by using six different toners for which an average circularity is different.

FIG. 23 is a graph of the results of the experiment carried out. Regarding the rank of the difference in densities of image, the description is similar to that mentioned earlier. From the graph, it was found that if the circularity of the toner is not less than 96%, the fifth rank can be maintained.

The circularity of toner is an average of circularity of all toner particles and was measured by the following method. The circularity of toner particles was measured by using FLOW PARTICLE IMAGE ANALYZER FPIA-2100 manufactured by SYSMEX CORPORATION. For the measurement, first of all 1% sodium chloride (NaCl) aqueous solution was prepared by using sodium chloride of first grade. Further, the aqueous solution of NaCl was filtered with a 0.45 filter to acquire 50 ml to 100 ml of solution and a surface active agent, desirably 0.1 ml to 5 ml of alkyl benzene sulfonate was added as a dispersing agent. Further, 1 mg to 10 mg of a sample was added to this mixture. The mixture was dispersed for one minute by using an ultrasonic disperser. The density of particles was adjusted to 5000 particles/μl to 15000 particles/μl and dispersion liquid was obtained. An image of the dispersion liquid was captured by a charged couple device (CCD) camera. A value obtained by dividing a circumferential length of a circle that has an area same as an area of a two-dimensional projection image of the toner by a peripheral length of the two-dimensional projection image of the toner, was used as the circularity of the each toner particle. From the point of view of pixel resolution of the CCD, toner for which a diameter (nominal diameter) of a circle that has an area same as that of the two-dimensional projection image of the toner is not less than 0.6 μm, was considered to be effective for use. The average circularity of the toner was calculated by adding the circularity of all toner particles in a range of measurement after obtaining the circularity of all toner particles and dividing the value upon addition by the number of toner particles.

In the description, a case in which a two-component developer is used is described. The same description also applies to a case in which a one-component developer is used. In such a case, the toner carrier on which the toner is adhered electrostatically is not the magnetic carrier but the surface of the developing roller 111 acts as the magnetic carrier.

The printer according to the second and the third embodiments includes the photosensitive drum 101 as a latent image carrying unit. The printer also includes the developing device 110 for developing which is provided with the developing roller 111 as a surface conveyor. The developing roller 111 carries toner that is charged to a predetermined polarity by allowing it to be adhered electrostatically on the magnetic carrier which is a toner carrier and is charged to a polarity opposite to that of the predetermined polarity of the toner, to the developing region opposite to the surface of the photosensitive drum. In the developing region, an image is formed after transferring finally on a recording material the toner image which is obtained by allowing the toner to be adhered on the latent image on the surface of the photosensitive drum 101 by the developing device 110. The printer further includes the developing roller 111, the supplying roller 113, the power supply 116, and the power supply 118 which apply voltage to the developing roller 111 and the supplying roller 113. The developing roller 111, the supplying roller 113, the power supply 116, and the power supply 118 form the toner-amount adjusting unit. The toner-amount adjusting unit adjusts the amount of toner that is allowed to be adhered on the magnetic carrier before being carried to the developing region such that the total amount of electric charge on the toner that is adhered on the magnetic carrier in the developing region is not greater than the total amount of electric charge on the magnetic carrier. Due to this, when the magnetic carrier and the toner are carried to the developing region, the adhesion of the toner on a non-latent image portion of the photosensitive drum 101 when the toner is fallen apart from the magnetic carrier, can be suppressed.

Thus, according to the second and third embodiments, a developing device that develops an image by using a single-component developer which includes the toner and the magnetic carrier is used as the developing device 110. If the toner carrier is a magnetic carrier, by using the developing device 110, the adhesion of the toner on a non-latent image portion of the photosensitive drum 101 when the toner is fallen apart from the magnetic carrier can be suppressed and the contamination of the surface of the medium can be reduced.

Further, if the amount of toner that is allowed to be adhered on the magnetic carrier is adjusted such that the ratio of the total amount of electric charge on toner to the total amount of electric charge on the magnetic carrier is not greater than 80%, the scatter of toner can be suppressed.

Further, the printer according to the second and the third embodiments includes an electrode roller 120 as a voltage applying member that applies AC voltage and an AC electric field is formed between the electrode roller 120 and the developing roller 111. Due to the AC electric field, even if the amount of toner that is allowed to be adhered on the magnetic carrier is adjusted, the adhesion of the toner on a non-latent image portion of the photosensitive drum 101 when the toner is fallen apart from the magnetic carrier can be suppressed and the contamination of the surface of medium can be reduced. Further, the difference between the image densities in the image can also be reduced.

The printer includes the stirrer 220 that stirs the developer which is held on the surface of the developing roller 111. Due to the stirring, even if the amount of toner that is allowed to be adhered on the magnetic carrier is adjusted, the adhesion of the toner on a non-latent image portion of the photosensitive drum 101 when the toner is fallen apart from the magnetic carrier can be suppressed and the contamination of the surface of the medium can be reduced. Further, the difference between the image densities in the image can also be reduced.

If a material which has a dynamic resistance in a range of $1\times10^{2}$ Ω to $1\times10^{11}$ Ω is used as a magnetic carrier, since the strong electric fields can be formed in order from an outer side of the radial direction of the developing roller 111 and the magnetic carrier can be replenished with the toner for replenishment in order from the outer side of the radial direction of the developing roller 111, the excessive adhesion of toner on the surface of the developing roller 111 becomes difficult.

If toner for which the average circularity is not less than 96% is used, the difference between the image densities in the image can be reduced.

The photosensitive drum 101, the developing device 110, and the toner-amount adjusting unit are structured as one integrated unit. The process cartridge is structured such that the integrated unit is detachable to from the printer, thereby facilitating the maintenance and the replacement of the photosensitive drum 101 etc.

Thus, a developing device that develops an image by using a single-component developer which includes the toner and the magnetic carrier is used as the developing device 110. Therefore, even if the surface of the developing roller 111 is let to be the toner carrier, the same effect as in a case of the magnetic carrier can be achieved.

In the embodiments of the present invention, a case in which an electrostatic latent image for reversal developing is formed on the photosensitive drum 101 is formed and reversal developing of the electrostatic latent image is performed, are described. However, the present invention is also applicable in a case of forming an electrostatic latent image for normal developing on the photosensitive drum 101 and performing normal developing of the electrostatic latent image that is formed.

In the embodiments of the present invention, a case in which a toner image that is formed on the photosensitive drum is transferred directly to the transfer paper, is described. However, the present invention is also applicable to a case in which the toner image on the photosensitive drum is first transferred to an intermediate transferring body and the toner image on the intermediate transferring body is then transferred to a transfer paper.

For example, the present invention is also applicable to a color image forming apparatus in which toner image for different colors are formed one after another on one photosensitive drum, then the toner images of different colors formed on the photosensitive drum are transferred by superimposing on an intermediate transfer belt which is an intermediate transfer body by a primary transferring device, and the superimposed toner images on the intermediate transfer belt are transferred collectively to a transfer paper by a secondary transferring device, and a developing device that is used in such a color image forming apparatus.

The present invention is also applicable to a tandem image forming apparatus and to a developing device that is used in the tandem image forming apparatus. In the tandem image forming apparatus, a plurality of image forming units which include photosensitive drums along a straight line portion of a movement path of an intermediate transfer belt which is an intermediate transfer body, are disposed in a row. A toner image of a different color is formed on the photosensitive drum in each image forming unit. The toner images on the photosensitive drums are transferred by superimposing on an intermediate transfer belt by a primary transferring device, and the superimposed toner images on the intermediate transfer belt are transferred collectively to a transfer paper by a secondary transferring devicetransferring device.

In the embodiments of the present invention, the printer and the developing device used in the printer are described. However, the present invention is also applicable to image forming apparatuses such as copying machines and facsimiles and to developing devices used in such image forming apparatuses.

Figure 24:
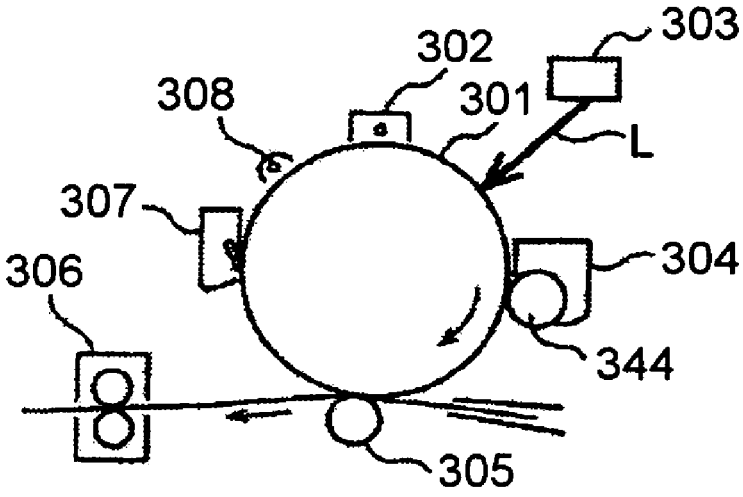
FIG. 24 is a schematic diagram of a printer according to the present embodiment.

A fourth embodiment in which the present invention is applied to a laser printer (hereinafter, "printer") which is an electrophotographic image forming apparatus is described below. To start with, the basic structure of the printer is described below. FIG. 24 is a schematic diagram of the printer. In FIG. 24, the printer includes a photosensitive drum 301 which is a latent image carrying unit around which units such as a charging unit 302, an exposing unit 303, a developing device 304, a transferring devicetransferring device 305, a cleaning unit 307, and decharging unit 308 are disposed. A fixing unit 306 is disposed on a left side of the transferring devicetransferring device 305 in the diagram.

The photosensitive drum 301 is in a position opposite to the charging unit 302 and is rotated in a clockwise direction in the diagram by a driving unit which is not shown in the diagram. The photosensitive drum 301 is charged uniformly to a polarity similar to that of toner as mentioned in the latter part. Apart from a charger that charges the photosensitive drum 301 by non-contact charging by cortoron etc., a charger such as a charging roller that applies charging bias to the photosensitive drum 301 by contact charging can be used. A surface of the photosensitive drum 301 which is charged uniformly carries an electrostatic latent image by optical scanning of laser beam L by the exposing unit 303 that drives a laser emitting unit that is not shown in the diagram, based on image information that is transmitted from a personal computer etc. When the electrostatic latent image passes through a developing region that is in a position opposite to the developing device 304 with the movement of the surface of the photosensitive drum 301, toner is allowed to be adhered and a toner image is developed.

The transferring devicetransferring device 305, in a downstream side of the developing region in a direction of rotation of the drum, forms a transferring nip by rotating a transferring roller while allowing it to be in contact with the surface of the photosensitive drum 301. Transferring bias of a polarity opposite to that of the toner is applied to the transferring roller by a power supply which is not shown in the diagram. The toner image which is developed on the photosensitive drum 301 enters into the transferring nip with the movement of the surface of the photosensitive drum 301.

A pair of registering rollers which is not shown in the diagram is provided on a right side of the transferring nip in the diagram. After a transfer paper that is fed from a paper feeding unit which is not shown in the diagram, is pinched between the pair of registering rollers, the registering rollers sends the transfer paper towards a transferring nip with a timing such that the transfer paper can be superimposed on the toner image on the photosensitive drum 301. Due to this, at the transferring nip, the toner image on the photosensitive drum 301 is pressed against the transferring paper while being superimposed. Due to the effect of nip pressure and a transferring electric field that is formed between the electrostatic latent image on the photosensitive drum 301 and the transferring roller on which the transferring bias is applied, the toner image is transferred electrostatically from the surface of the photosensitive drum 301 to the transfer paper. Apart from the transferring roller shown in the diagram, a transferring belt or a transferring charger can be used as the transferring devicetransferring device 305.

The transfer paper to which the toner image is transferred, that has come out from the transferring nip with the rotation of the photosensitive drum 301 and the transferring roller, is sent to the fixing unit. The fixing unit 306 includes a fixing roller that has an inbuilt heat generating unit such as a halogen lamp which is not shown in the diagram and a pressing roller that is in contact with the fixing roller and which rotates. The fixing roller and the pressing roller form a fixing nip in which the transfer paper that is sent is pinched. Further, the toner image is fixed on the transfer paper by heating and pressing.

Toner adhered on a surface of the photosensitive drum 301 which is remained after the surface of the photosensitive drum 301 through the transferring nip, is removed by the cleaning unit 307. After cleaning of the surface of the photosensitive drum 301, the decharging unit 308 removes electric charge that is remained on the surface. The surface of the photosensitive drum 301 is then initialized after uniform charging by the charging unit 302.

Figure 25:
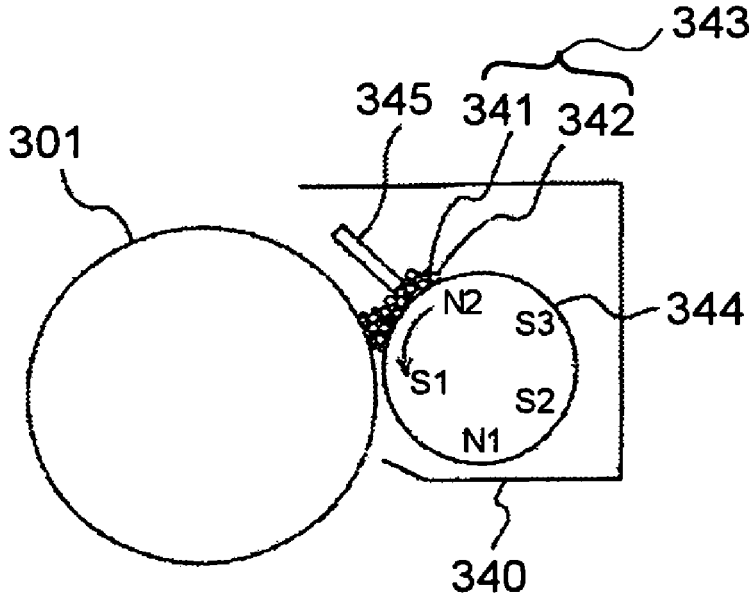
FIG. 25 is an enlarged schematic diagram of a developing device in the printer.

FIG. 25 is a schematic diagram of the developing device 304. As shown in FIG. 25, the developing device 304 includes a developer receptacle 340 which contains a two-component developer 343. The two-component developer 343 includes a carrier 342 and toner 341 that is negatively charged. The developing device 304 further includes a developing sleeve 344 which is a developer carrying unit. The developing sleeve is disposed opposite to the photosensitive drum 301 with a predetermined distance (hereinafter, "developing gap") from the photosensitive drum 301. A part of the developing sleeve 344 is exposed from an opening 340*a* of the developer receptacle 340. The developing device 304 further includes components such as a regulator 345, a stirrer (not shown in the diagram), and a toner-concentration sensor (not shown in the diagram). The regulator 345 regulates a layer thickness of the developer on the developing sleeve 344. The stirrer stirs the two-component developer 343 in the developer receptacle 340.

Figure 26A:
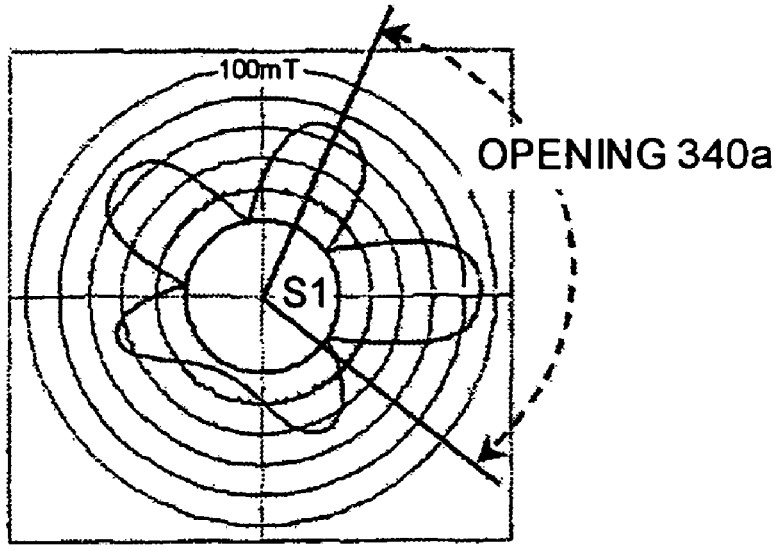
FIG. 26A is a diagram of a magnetic flux density distribution of a magnet roller that is built into a developing sleeve of the developing device.

The developing sleeve 344 includes a non-magnetic material in the form of a pipe which is rotated in a counter-clockwise direction by a driving unit which is not shown in the diagram. The non-magnetic material in the form of a pipe includes a magnet roller fixed such that the magnet roller is not rotated with the non-magnetic material. The magnet roller includes five magnetic poles S1, N1, S2, S3, and N2 which are arranged along the circumference from a position of the developing region. FIG. 26A is a waveform diagram of a magnetic flux distribution of the magnet roller. As shown in FIG. 26A, among the magnetic poles, the magnetic pole S1 which is at the opening of the developer receptacle 340 is a developing magnetic pole that is disposed opposite to the developing region and is the strongest among the five magnetic poles. The magnetic pole S1 has a function of forming a magnetic brush by erecting the two-component developer on the developing sleeve 344 in the developing region. The magnetic brush which is formed on the developing sleeve 344 by the magnetic force of the magnetic pole S1 passes through the magnetic gap G while the tip of the magnetic brush scraping the photosensitive drum 301.

According to the fourth embodiment, the photosensitive drum 301 has a diameter of 50 mm, and it rotates at a linear velocity of 200 mm/sec in a clockwise direction in the diagram. The developing sleeve 344 has a diameter $\phi$ of 18 mm and it rotates at a linear velocity of 300 mm/sec in a counter-clockwise direction in the diagram. The developing gap is formed between the photosensitive drum 301 and the developing sleeve 344 which rotate. The developing gap can be set in a range of 0.4 mm to 0.8 mm and the developing efficiency can be improved by reducing the developing gap. Electric potential VD in the non-image portion of the photosensitive drum 301, electric potential VL in the latent image portion, and electric potential VB of the developing sleeve (electric potential of developing bias that is applied) are −350 V, −50 V, and −250 V respectively. Therefore, in the developing region, developing potential of 200 V (VL−VB=200) acts on toner at the tip of the magnetic brush that scrapes the latent image portion of the photosensitive drum 301. Due to this, a toner image is formed by an electrostatic transfer from a surface of the magnetic carrier to the latent image portion of the photosensitive drum 301. On the other hand, since non-developing potential of −100 V (VD−VB=−100) acts on a magnetic brush that scrapes the non-image portion of the photosensitive drum 301, adhesion of the toner on the non-image portion is prevented.

The magnetic brush that has passed through the developing region with the rotation of the developing sleeve 344 is flattened with decrease in the magnetic force and moves while being constrained to the developing sleeve 344 due to the magnetic force of the magnetic pole N1. Further, due to the effect of a repulsing magnetic field which is formed between the magnetic poles S2 and S3, the magnetic brush is separated apart from the surface of the developing sleeve 344 and is returned to the developer receptacle 340. After this, in a down-stream side of the repulsing magnetic field in a direction of rotation of the sleeve, the two-component developer in the developer receptacle 340 is drawn to the surface of the developing sleeve 344. Layer thickness of the two-component developer drawn is regulated in a doctor gap that is formed between the tip of the regulator 345 and the surface of the developing sleeve 344, and the two-component developer is then carried to the developing region. The magnet N2 is disposed in a position where the layer thickness is regulated by the regulator 345. Frictional charging of the toner is accelerated in the two-component developer in which the thickness of the layer is regulated while being attracted to the surface of the developing sleeve 344 by the magnetic pole N2.

The following is the characteristic structure of the printer according to the fourth embodiment. The two-component developer 343 on the developing sleeve 344 forms a magnetic brush along a magnetic flux density vector from the magnetic poles S1, N1, S2, S3, and N2 of the magnet roller that is built into the developing sleeve 344. The magnetic brush is erected and the erected magnetic brush is flattened with the change in the magnetic flux density. The movement of the magnetic brush becomes fast, particularly the movement of the carrier 343 at the tip of the magnetic brush becomes fast in a region of magnetic brush erection and in a region of magnetic brush flattening. At this time, if the amount of electric charge on the toner is small and the electrostatic adhesion between the toner 341 and the carrier 342 is weak, the toner cannot follow the change in the movement of the carrier 342 and is separated apart from the carrier and scattered away. In other words, if the adhesion between the toner 341 and the carrier 342 becomes less than the inertial force developed in the toner 341 with the change in the movement of the carrier, the toner 341 is separated apart from the carrier 342 and scattered away. Here, if the electrostatic adhesion in the toner 341 that is charged electrically and the carrier 342 is Fq, the maximum inertial force of the toner 341 in the opening 340*a* is Fdmax, and the coefficient of dynamic friction of the toner 341 with respect to the carrier 342 is μ, the scatter condition is expressed by the following equation C7.

$$\mu Fg < Fdmax \tag{C7}$$

The electrostatic adhesion Fq between the toner 341 and the carrier 342 is calculated by the following formula C8. From the relational equation C8, it can be seen that smaller the amount of electrical charge and bigger the particle size of the toner, the electrostatic adhesion between the toner 341 and the carrier 342 is less. The constant k in this relational equation is roughly 0.5.

$$Fg = \frac{k}{4\pi\varepsilon_0}\left(\frac{g}{r}\right)^2 \tag{C8}$$

where π: ratio of circumference of a circle to it's diameter $\in_0$: dielectric constant in vacuum [F/m]

k: constant g: amount of electric charge on toner particle [c]

r: radius of toner particle [m]

The inertial force Fd of the toner 341 is calculated by the following relational equation C9. In this equation, the change in speed a, is found by actually tracking the position of the magnetic brush by a high-speed camera and is an acceleration of a component of tangential direction at the point of intersection of the toner 341 and the carrier 342. The coefficient of dynamic friction g of the toner 341 and the carrier 342 can be estimated by measuring an angle of repose of the developer. Normally, the coefficient of dynamic friction is a value from 0.3 to 0.5.

$$Fdmax = \frac{4}{3}\pi \cdot r^3 \cdot \sigma \cdot a \tag{C9}$$

where π: ratio of circumference of a circle to it's diameter r: radius of toner particle [m]

σ: density [kg/m$^2$]

a: change in speed of magnetic brush [m/s$^2$]

In the developing sleeve 344, if a proportion of the toner 341 which fulfils the relational equation C7, i.e. a proportion of insufficiently charged toner for which a product of the electrostatic adhesion Fq and the coefficient of dynamic friction becomes less than the inertial force Fdmax, becomes large, the scatter of the toner increases to an extent that it causes conspicuous contamination of the surface of the medium. Taking this into consideration, the inventors of the present invention carried out the following experiment.

Figure 27:
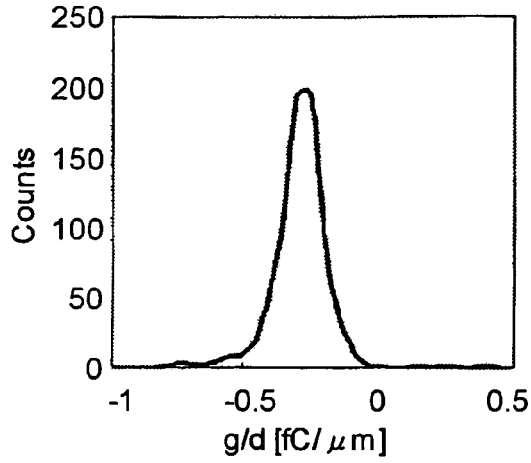
FIG. 27 is diagram of a distribution of an amount of electric charge of toner that has been used conventionally.
Figure 28:
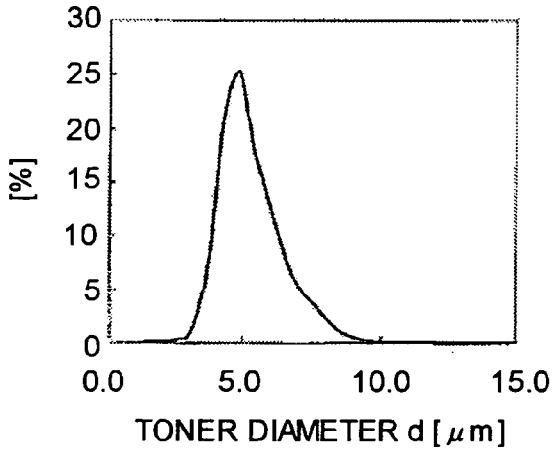
FIG. 28 is a diagram of a distribution of a particle size of toner that has been used conventionally.
Figure 29:
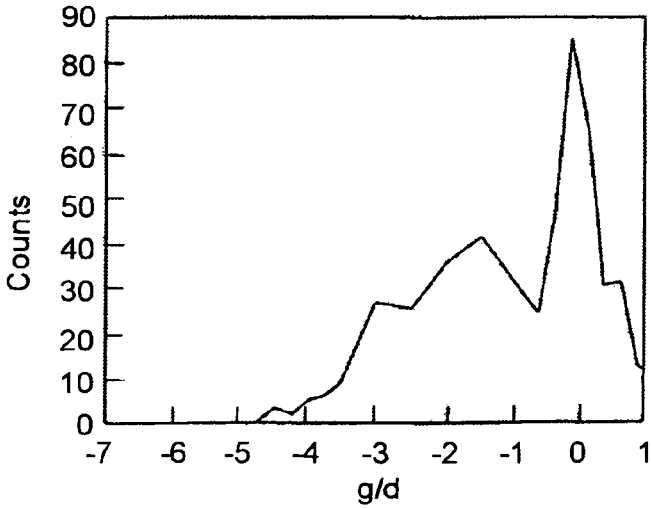
FIG. 29 is a diagram of a distribution of an amount of electric charge of toner that is scattered.
Figure 30:
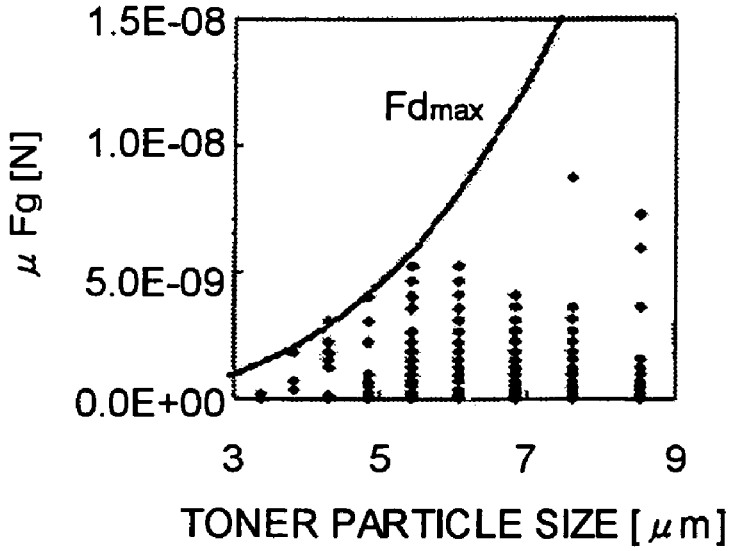
FIG. 30 is a graph of characteristics of a relationship between a carrier particle size and an amount of toner scattered.

To start with, a distribution of an amount of electric charge and a distribution of a particle size of toner that have been in normal use conventionally are shown in FIGS. 27 and 28. Using this toner, the actual developing is carried out in the developing device 304. The toner that is scattered is collected outside the developing device 304 and the distribution of an amount of electric charge is measured by E-SPART analyzer manufactured by HOSOKAWA MICRON COMPANY. The results of the measurement are shown in FIG. 29. As shown in FIG. 29, the scattered toner has shown the distribution of an amount of electric charge which indicates the so-called two-peak form that has a zero peak and a low peak in a region of less electric charge than the zero peak. A relationship between the μFq and Fdmax for toner diameter was examined from these results. The results of this are shown in FIG. 30. From the results in FIG. 30, it was found that the toner which fulfils the relational equation C7 is scattered.

Figure 31:
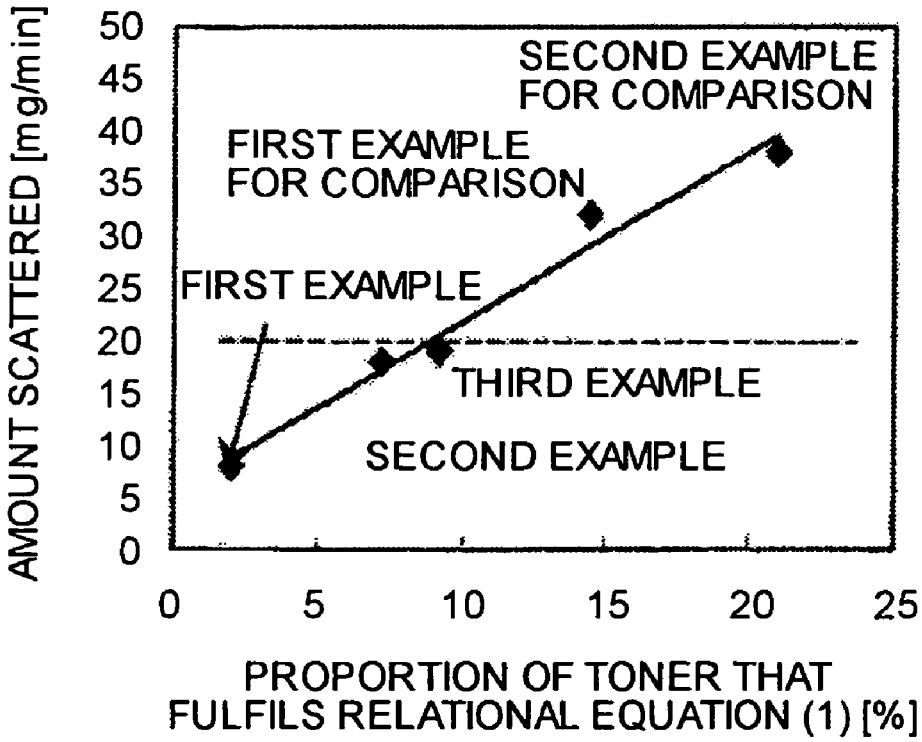
FIG. 31 is a graph of characteristics of a relationship between an amount of toner scattered and a proportion of toner that fulfils a relational equation C7.

Further, various toners of different charging characteristics were arranged and a relationship between a proportion of toner that fulfils the relational equation C7 and an amount of scattered toner was examined. The results are shown in FIG. 31. The charging characteristics of toner were allowed to change by changing charging characteristics of the carrier. Carriers that are used have different charging characteristics but the same conditions except the charging characteristics. From the results in FIG. 31, it was found that when toner in the first to third examples for which the proportion of toner that fulfils the relational equation C7 is not greater than 10%, is used, the amount of toner scattered can be controlled to be not more than 20 mg/min. Whereas, when toner in the first-and second examples for comparison for which the proportion of toner that fulfils the relational equation C7 is more than 10% is used, it was found that the amount of toner scattered is more than 20 mg/min. It has been confirmed from measurement data for various types of image forming apparatuses in which a developing roller of width 300 mm for a paper of A3 size was used, that a level of the scatter of toner which does not affect the image formation is less than or equal to 20 mg/min. From this, it was found that if the proportion of the toner that fulfils the relational equation C7 is controlled to be not greater than 10%, the amount of toner scattered can be reduced to an extent that it does not affect the image formation.

Moreover, in the developing device 304, to control the proportion of the toner that fulfils the relational equation C7 to be not greater than 10%, it is desirable that the inertial force Fdmax of the toner is reduced. In order to reduced the inertial force Fdmax of the toner, the change in speed a of the magnetic brush, i.e. a change in the magnetic flux density vector is to be reduced. By reducing the maximum dBrmax of a change in a magnetic flux density Br in a normal direction dBr (=Br/dθ) in the opening, the change in the magnetic flux density vector can be reduced. Particularly, if the toner is scattered in the opening 340*a* of the developer receptacle 340, it may get adhered on the ground surface of the photosensitive drum 301 from the opening 340*a* and contaminate other components of the unit. Further, the opening 340*a* of the developer receptacle 340 is structured such that the magnetic flux density of the magnetic electrode S1 which is a developing electrode in general is the maximum. Therefore, reducing the change in the magnetic flux density vector of the developing electrode (magnetic electrode S1) prevents the scatter of the toner substantially.

Figure 26B:
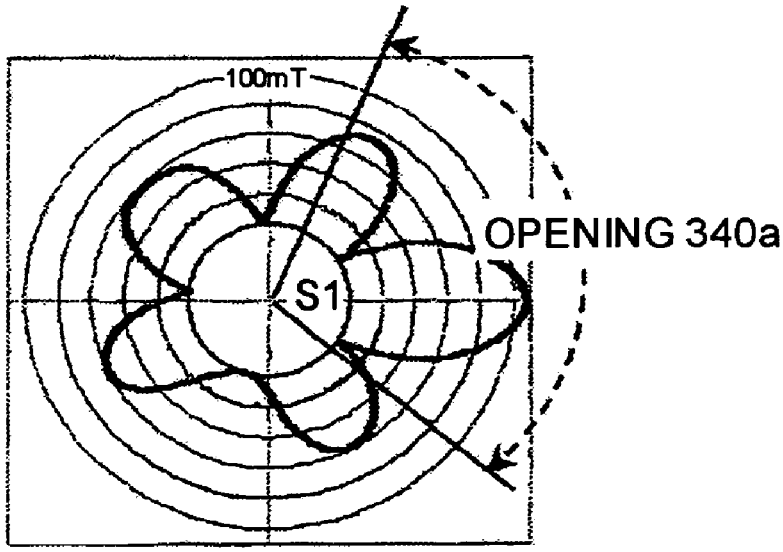
FIG. 26B is a diagram of a magnetic flux density distribution of a magnet roller that is built into a developing sleeve of a conventional developing device.

FIG. 26A is a diagram of a magnetic flux density distribution of a magnet roller that is built into the developing sleeve of the developing device. FIG. 26B is a diagram of a magnetic flux density distribution of a magnet roller that is built into a developing sleeve of a conventional developing device. The change in the magnetic flux density of the developing electrode of the magnetic flux density distribution shown in FIG. 26B is 0.68 T/deg and the amount of toner scattered became 33 mg/sec. Whereas, when the change in the magnetic flux density of the developing electrode of the magnetic flux density distribution shown in FIG. 26A is 0.43 T/deg, the amount of toner scattered was reduced to 19 mg/sec. From this result, it was found that by reducing the change in the magnetic flux density of the magnetic electrode S1 which is a developing electrode, the scatter of the toner can be prevented substantially. It is desirable that the change is the magnetic flux density is as small as possible. However, it has been confirmed that if the change in the magnetic flux density is not greater than 0.2 T/deg, the magnetic flux density is not sufficient to form the magnetic brush.

Further it is desirable to use a carrier which has a particle size not greater than 35 μm in the toner. This is because if the particle size of the carrier is small, the magnetic moment generated in the carrier becomes small and the change in the speed of the magnetic brush is reduced. Smaller is the particle size, the change in the speed of the magnetic brush is reduced. However, it has been confirmed that if the particle size of the carrier is less than five times that of the toner, the toner becomes spacer and gets adhered on a surface of the carrier. This hinders forming of a suitable magnetic brush.

Figure 32:
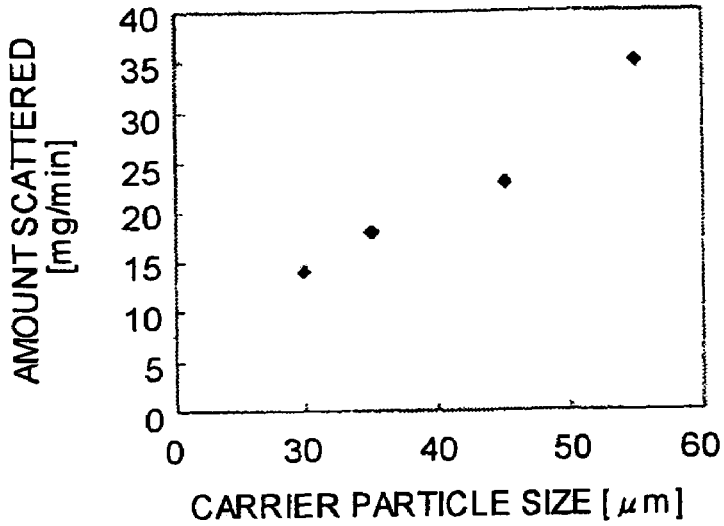
FIG. 32 is a graph of characteristics of a relationship between the amount of toner scattered and the carrier particle size.

FIG. 32 is a graph of characteristics of a relationship between the amount of toner scattered and the carrier particle size. As shown in FIG. 32, by setting the particle size of the carrier not greater than 35 μm, the amount of toner scattered can be suppressed to 19 mg/min.

It is desirable to specify toner which includes toner of particle size from 3 μm to 7 μm in more than 70% of ratio of number of particles. This is because if the ratio of toner count of toner with particle size smaller than 3 μm becomes more, the toner behaves as fine toner and the amount of charging is extremely high which results in deterioration of the developing capability. This is also because, if the ratio of toner count of toner with particle size bigger than 7 μm becomes more, the electrostatic adhesion Fq deteriorates and there is a sudden increase in the amount of toner scattered.

If the magnet roller and the carrier are let to be fixed conditions, a=dv/dt in the inertial force Fd exerted on the toner can be considered as a constant. Then, from-the relationship in the relational equation C7, if α is used as an index of scatter condition of toner, i.e. an index of electrostatic adhesion, the following relational equation can be derived. In the following equation d (=2r) is a particle size of the toner. The index of toner αin the first and second examples in the first experiment and the first, second, and the third examples for comparison is $0.2\times10^{-3}$.

$$\alpha > \frac{g^2}{d^5} \qquad \alpha = \frac{\pi^2 \cdot \sigma \cdot \varepsilon_0}{6k \cdot \mu} \frac{dv}{dt} \tag{C10}$$

Figure 33:
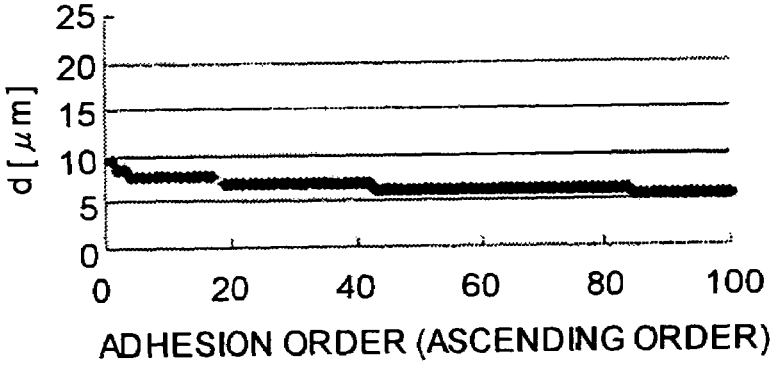
FIG. 33 is a graph of characteristics of a relationship between an electrostatic adhesion and a toner particle size.

FIG. 33 is a graph of toner particle size d of toner that is scattered from the developing device sorted and arranged in an ascending order of the electrostatic adhesion α by using toner of an average particle size 5.5 μm. From the results of the graph is FIG. 33, if the particle size of the toner is bigger than 7 μm, the non-electrostatic adhesion α becomes extremely small. From this, it was found that the toner having particle size bigger than 7 μm tends to scatter easily.

Figure 34:
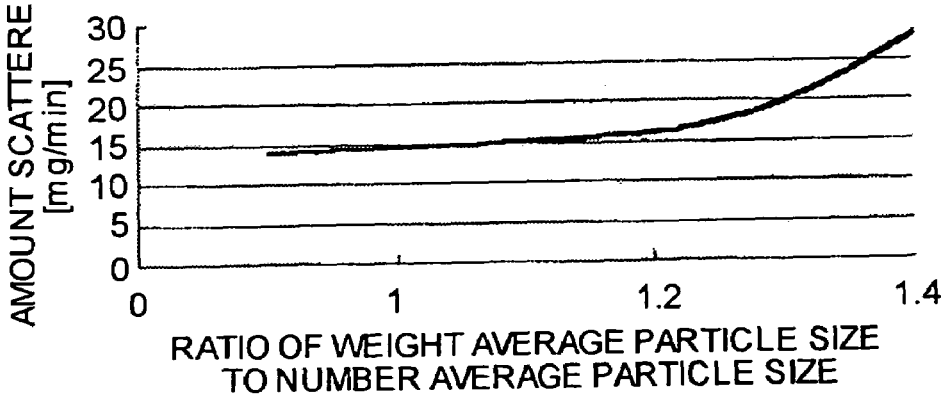
FIG. 34 is a graph of characteristics of a relationship between a degree of dispersion β (weight average particle size/number average particle size) and the amount of toner scattered.

It is desirable to use toner which has a degree of dispersion β (weight average particle size/number average particle size) of an average particle size not greater than 1.3. This is because, as the degree of dispersion β increases, the particle size distribution becomes broad and due to this there is an increase in a proportion of toner having a large particle size for which the amount of electric charge decreases, and the toner tends to scatter easily. Concretely, the inventors of the present invention examined a relationship between an amount of toner scatter and a degree of dispersion β that is calculated as described in the latter part. The results of this are shown in FIG. 34. From the results shown in FIG. 34, it was found that if the degree of dispersion is allowed to be not greater than 1.3, the amount of toner scattered can be controlled easily to be not greater than 20 mg/min which is an upper limit for the toner scatter.

The degree of dispersion β can be calculated as described below. To start with, an average particle size and a particle size distribution of toner is measured by using COULTER MULTISIZER 30 manufactured by BECKMAN COULTER COMPANY and a personal computer manufactured by IBM in which an analysis software manufactured by BECKMAN COULTER COMPANY is installed. While carrying out the measurement, a value of Kd was set by using a standard particle and aperture current was set by automatic setting. 1% NaCl aqueous solution prepared by using sodium chloride of first grade was used as an electrolyte. ISOTON-II manufactured by COULTER SCIENTIFIC JAPAN COMPANY can be used instead of 1% NaCl aqueous solution. 0.1 ml to 5 ml of a surface active agent (desirably alkyl benzene sulfonate) was added to 100 ml to 150 ml NaCl aqueous solution and 2 mg to 20 mg of measurement sample was added to this solution mixture. The electrolyte in which the sample is suspended was allowed to undergo dispersion in an ultrasonic disperser for one minute to three minutes. By using a 100 μm aperture tube, sampling of 50,000 particles of toner of size not less than 2 μm was done and a number average particle size and a weight average particle size was calculated. The number average particle size is an average value obtained arithmetically by multiplying the average particle size by the number of particles in each channel, whereas the weight average particle size in a value obtained by dividing the volume of all particles by the total area and is $dw=\Sigma nd4/\Sigma nd3$. Since the value of dw becomes bigger as the particle size distribution becomes broader, the degree of dispersion β can be expressed by a ratio to the number average.

Figure 35:
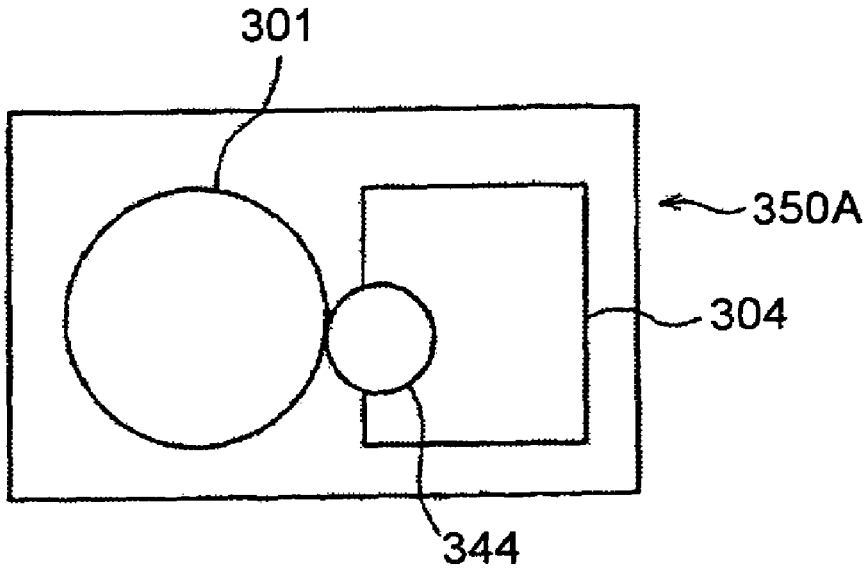
FIG. 35 is an illustration of a process cartridge.

FIG. 35 is an illustration of a process cartridge 350A according to the fourth embodiment.

As shown in FIG. 35, the process cartridge 350A includes the photosensitive drum 301 and the developing device 340 structured as an integrated unit of the process cartridge which is detachable from the printer.

By making a process cartridge that is detachable from the printer, the maintenance and the replacement are facilitated. For example, in a case of a break down due to a fault in a component or a unit, the apparatus can be put in the original condition in a short time just by replacing the process cartridge, thereby reducing the servicing time.

Further, in the developing device according to the fourth embodiment, since the contamination by toner can be reduced, the contamination of the surface of the photosensitive drum and inside of the process cartridge by toner can be reduced as compared to that in the conventional image forming apparatuses. As a result, forming of faulty images can be reduced and the process cartridge can have a longer life.

The following is a description of a first modified example of another process cartridge according to the fourth embodiment.

Figure 36:
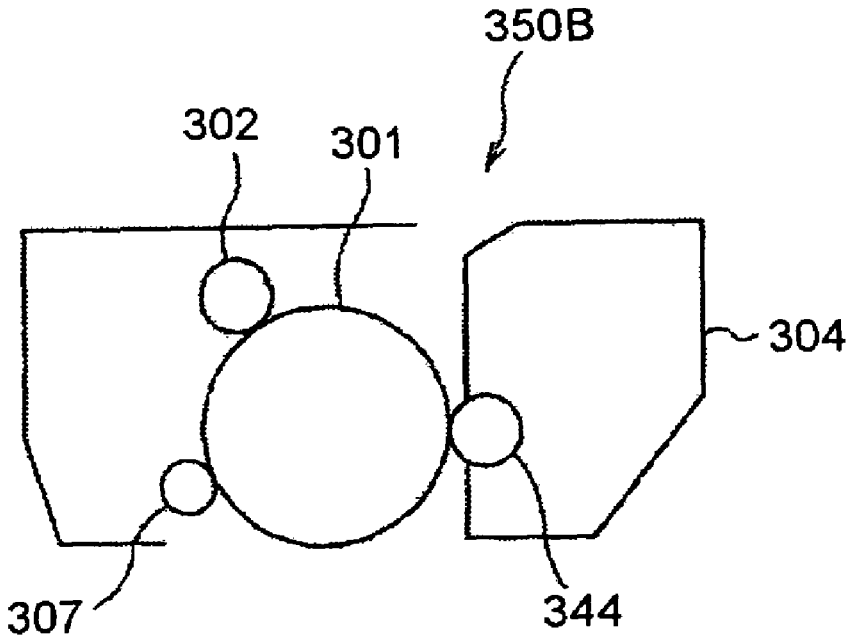
FIG. 36 is an illustration of another process cartridge.

FIG. 36 is an illustration of a process cartridge 350B in the first modified example.

Basic operation and structure of units such as the photosensitive drum 301 and the developing device 304 in the process cartridge 350B are similar to those in the process cartridge in the fourth embodiment. The process cartridge is detachable from the image forming apparatus in the similar manner. The difference is in a structure of the integrated unit of the process cartridge. In other words, in the process cartridge 350A according to the fourth embodiment, the photosensitive drum 301 and the developing device 304 are integrated to form the integrated unit, whereas in the process cartridge 350B in the first modified example the cleaning unit 307, the charging unit 302, the photosensitive drum 301, and the developing device 304 are integrated to form the integrated unit.

Further, in the structure of the process cartridge 350B any one of the cleaning unit 307 and the charging unit 302 can be integrated with the developing device 304 and the photosensitive drum 301 to form the integrated unit. Other units can also be added to the process cartridge.

Thus, by making a process cartridge that is detachable from the printer, the maintenance and the replacement are facilitated as compared to the process cartridge in which the photosensitive drum 301 and the developing device 304 are integrated to form an integrated unit.

Moreover, according to the developing device in the first modified example, since the contamination by toner can be reduced, the load on the surface of the photosensitive drum 301, the cleaning unit 307, and the charging unit 302 can be reduced as compared to that in the conventional image forming apparatuses and the deterioration of each unit can be suppressed. As result, forming of faulty images can be reduced and the process cartridge can have a longer life. Thus, the frequency of replacement of the process cartridge can be reduced, thereby saving the resources.

Thus, in the printer according to the fourth embodiment, since the charging characteristics of the toner are set such that the proportion of the toner that fulfils the relational equation C7 is not greater than 10%, the contamination of the surface of the medium due to the scatter of toner and deterioration of the unit can be suppressed as compared to that in the conventional image forming apparatuses.

In the printer according to the fourth embodiment, since the maximum of the change in the magnetic flux density of the magnetic flux density distribution at the opening 340*a* of the developer receptacle, particularly at the magnetic electrode S1 which is a developing electrode, can be suppressed to be not greater than 0.45 T/deg and the inertial force Fdmax of the toner can be suppressed to be small, the amount of toner that is separated apart from the carrier is small and the contamination of the surface of the medium and deterioration of the unit caused by the scatter of toner can be suppressed.

Further, by using toner which has a particles size of carrier not bigger than 35 μm the change in the speed of the magnetic brush is reduced and the inertial force Fdmax of the toner is suppressed to be small. Therefore, the amount of toner that is separated apart from the carrier and scattered is less and the contamination of the surface of the medium and the deterioration of the unit due to the scatter is suppressed.

In the printer according to the fourth embodiment, toner which includes toner of particle size from 3 μm to 7 μm is more than 70% of toner count ratio. Therefore it is possible to control the deterioration of the developing capability caused due to excessive charging and thereby suppressing the contamination of the surface of the medium and the deterioration of the unit due to the scatter of toner.

In the printer according to the fourth embodiment, by using toner for which the value obtained by dividing the weight average particle size by the number average particle size is not greater than 1.3, it is possible to suppress assuredly the contamination of the surface of the medium and the deterioration of the unit due to the scatter of toner.

In the printer according to the fourth embodiment, the integrated unit of the process cartridge in which the developing device 304 and the photosensitive drum 301 are integrated, is made to be detachable from the printer. This has facilitated the maintenance and replacement jobs. Further, by reducing the contamination by toner as compared to that in the conventional apparatuses, the contamination by the toner inside the process cartridge can be suppressed as compared to that in the conventional apparatuses. As a result, forming of faulty images can be reduced and the process cartridge can have a longer life.

Moreover, in the printer according to the fourth embodiment, the integrated unit of the process cartridge in which the developing device 304, the photosensitive drum 301, the cleaning unit 307, the charging unit 302 are integrated is made to be detachable from the printer. This has facilitated the maintenance and replacement jobs. Further, by reducing the contamination by toner as compared to that in the conventional apparatuses, the contamination by the toner inside the process cartridge can be suppressed as compared to that in the conventional apparatuses. As a result, forming of faulty images can be reduced and the process cartridge can have a longer life.

According to these inventions, the amount of weakly charged toner that passes through the opening per unit time shown by the following equation is calculated by taking into consideration the amount of developer that is held on the developer carrying unit, the linear velocity of the developer carrying unit and regulating the amount of weakly charged toner was considered to be effective in controlling the scatter of the toner.

$$\text{Amount of toner that passes through the opening per unit time } [g \cdot mm/min] = \text{total amount to be drawn } [g/min] \times \text{length of opening} \times \text{concentration of toner } T.C. \ [\% \text{ by mass}] \times \text{proportion } WST \text{ of weakly charged toner } [\%]$$

In this equation, the total amount to be drawn [g/min] =amount to be drawn [g/mm$^2$]×width of drawing [millimeter (mm)]×linear velocity of the developer carrying unit [mm/min]

This equation indicates that the amount of weakly charged toner passing through the opening per unit time increases not only with the proportion WST [%] of the weakly charged toner which is a proportion of the weakly charged toner in the developer, but also with the increase in the amount to be drawn, the increase in the linear velocity of the developer carrying unit, the widening of the area of the opening, and the increase in the density of the toner. Further, larger is the quantity of the weakly charged toner that passes through the opening per unit time, the scatter of the toner is considered to be conspicuous. To overcome this, the inventor(s) of the present invention, carried out the experiment mentioned below and examined a relationship between the quantity of the weakly charged toner that passes through the opening per unit time expressed by the relational equation with an amount of toner scattered. It was found by this experiment that not only a toner that is charged with an opposite -polarity, but if it is a negatively charged toner, the toner that is charged to not less than −0.1 [fC/μm] and if it is a positively charged toner, the toner that is charged to not more than 0.1 [fC/μm] contributes to the scatter of the toner to a great extent. Based on this, in the q/d distribution of toner, for the negatively charged toner, a proportion of toner that is charged to not less than −0.1 [fC/μm] and for the positively charged toner, a proportion of toner that is charged to not more than 0.1 [fC/μm] was used as the proportion WST [%] of the weakly charged toner. From this experiment, it was found that if the amount of weakly charged toner that passes through the opening per unit time is adjusted to be not more than 200 g·mm/min, the scatter of the toner can be reduced up to an extent such that there is not excessive concentration of toner. This indicates that by adjusting the toner such that the proportion WST [%] of weakly charged toner is not more than 200 [g·mm/min] to match with the drawing amount [g/min] of the developing device, the area of the opening [mm$^2$], and the density of the toner T.C. [% by mass], the scatter of the toner in the developing device can be suppressed. Further, as mentioned below in a third experiment, when a toner for which the proportion WST [%] of the weakly charged toner becomes high due to an improvement in image at other image forming steps, the total amount to be drawn [g/min] and the area [mm$^2$] of the opening of the developing device is reduced in a range such that it does not affect the image quality. By reducing the total amount to be drawn, the amount of the weakly charged toner that passes through the opening per unit time can be suppressed to be less than or equal to 200 g·mm/min. Thus, by suppressing the amount of the weakly charged toner, even if a toner having a high proportion WST [%] of the weakly charged toner is used, the scatter of the toner can be suppressed in the developing device. In other words, it is possible to regulate conditions that can control an image with the concentration of toner caused due to the scatter of the toner in the developing device including the effect of the high speed of the developing device, the size of the opening, the amount of the developer held on the developer carrying unit etc. as compared to the conventional image.

The contamination due to falling apart of the toner from the toner carrier in the developing region in spite of the sufficient charging of the toner is due to the fact that the total amount of electric charge of the toner that is adhered on the toner carrier with a certain electric charge, becomes more than the electric charge of the toner carrier. In other words, if the toner carrier with toner adhered on it is observed from outside, the electric charge of the toner carrier can be considered as an electric charge that is saturated by an amount of electric charge of the toner of the opposite polarity that is adhered on the toner carrier. Therefore, if the toner, for which the total amount of electric charge is more than the amount of electric charge of the toner carrier, is adhered on the toner carrier, the electrostatic attraction acting on a part of the toner becomes weak and even if it is a sufficiently charged toner, the toner falls apart from the toner carrier.

For this reason, in the image forming apparatus and the process cartridge according to the present invention, the amount of toner that is allowed to be adhered on the toner carrier is adjusted by a toner-amount adjusting unit before carrying it to the developing region. Concretely, the total amount of electric charge of the toner that is adhered on the toner carrier in the developing region is adjusted to be less than or equal to the total amount of electric charge of the toner carrier. By doing so, sufficient electrostatic attraction can be secured for each toner that is adhered on the toner carrier. As a result, when the toner and the toner carrier that is adjusted in such a manner are carried to the developing region, it is possible to suppress the toner from falling apart from the toner carrier and adhering on a non latent-image portion of the latent image carrying unitimage carrying unit. Here, the toner carrier is charged to a polarity opposite to that of the charging polarity of the toner and carries the toner up to the developing region. For example, in a case of using a two-component developer, a magnetic carrier is a toner carrier and in a case of using a one-component developer, a surface of a surface conveyor such as a developing roller etc. is a toner carrier.

According to the present invention, due to a reason described below, it is possible to suppress the deterioration of the unit and contamination of the surface of the medium caused by the scatter of toner, more effectively than in the conventional technology. In other words, the two-component developer on the developer carrying unit forms a magnetic brush along a magnetic flux density vector of a magnetic field generating unit built into the developer carrying unit. With a change in the magnetic flux density, the movement of the magnetic brush, especially the movement of the carrier at the tip of the magnetic brush becomes faster in a region of magnetic brush erection and in a region of magnetic brush flattening. At this time, if the amount of electric charge on the toner is small and the electrostatic adhesion between the toner and the carrier is weak, the toner cannot follow the change in the movement of the carrier and the toner is separated apart from the carrier and scattered away. In other words, if the adhesion between the toner and the carrier becomes less than the inertial force developed in the toner with the change in the movement of the carrier, the toner is separated apart from the carrier and is scattered away. If the electrostatic adhesion between the toner that is charged electrically and the carrier is Fq, the maximum inertial force of the toner in the opening is Fdmax, and the coefficient of dynamic friction is μ, a scatter condition of the toner in this case can be expressed by the following relational equation (1).

$$\mu Fg < Fd\max \quad (1)$$

On the developer carrying unit, if a proportion of toner that fulfils the relational equation (1), i.e. a proportion of insufficiently charged toner for which a product of the electrostatic adhesion Fq and the coefficient of dynamic friction μ becomes less than the inertial force Fdmax, becomes large, the scatter of the toner increases to an extent that it causes conspicuous contamination of the surface of the medium. Taking this into consideration, the inventors of the present invention carried out an experiment mentioned below and examined a relationship between the proportion of the insufficiently charged toner that fulfills the relational equation (1) and the amount of scatter of toner. Upon examination, it was found that if the number proportion [%] of the insufficiently charged toner is controlled to be less than or equal to 10%, the scatter of the toner can be reduced to an extent such that there is no contamination of the surface of the medium. Therefore, by setting the charging characteristics of the toner such that the number proportion [%] of the insufficiently charged toner on the developer carrying unit is controlled to be less than or equal to 10%, the scatter of the toner, the contamination, and the deterioration of the developing device can be suppressed as compared to that in the conventional technology.

According to an invention, in aspects from the first to the eighth aspects, the concentration of toner at certain locations in an image due to the scatter of toner can be suppressed.

According to an invention in aspects from the ninth to the seventeenth aspect, the concentration of toner at certain locations in a image due to excessive adhesion of toner on the toner carrier which occurred in spite of the sufficient charging of the toner conventionally, can be suppressed.

According to an invention in aspects from the eighteenth to the twenty sixth aspect, it is possible to provide an image forming apparatus and a developing device and a process cartridge that is to be mounted in the image forming apparatus which can suppress the concentration of toner at certain locations in an image due to the scatter of toner and the deterioration of the unit compared to that in the conventional technology.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A developing device comprising:

a developer carrying unit including a non-magnetic sleeve rotatable and a magnetic field generating unit;

a developer receptacle configured to receive a two-component developer including toner and a magnetic carrier; and an opening through which a portion of the developer carrying unit opposite to a latent image carrying unit configured to carry a latent image is exposed, wherein the magnetic field generating unit is configured to draw the two-component developer onto a surface of the developer carrying unit so as to carry the two-component developer to the opening, form a magnetic brush by erecting the two-component developer on the developer carrying unit at the opening, apply a developing bias on the developer carrying unit so as to develop the latent image with the toner supplied to the latent image on the latent image carrying unit from the magnetic brush, and an amount of weakly charged toner in the two-component developer passing through the opening per unit time is not greater than 200 g·mm/min, wherein the amount of weakly charged toner is expressed by an equation, which is the amount of weakly charged toner [g·mm/min] = total amount of the two-component developer to be drawn [g/min] × length of the opening [mm] × a concentration of toner [wt %] × percentage of weakly charged toner [%]

wherein the total amount of the two-component developer to be drawn is expressed by an equation, which is the total amount of the two-component developer to be drawn [g/min] = an amount of the two-component developer to be drawn [g/mm$^2$] × drawing width [mm] × linear velocity of a developing roller [mm/min]

and the percentage of weakly charged toner [%] is a percentage of toner having a charge of not less than −0.1 fC/μm if the toner is negatively charged, and is a percentage of toner having a charge not greater than 0.1 fC/μm if the toner is positively charged, according to a distribution of charge per particle size.

2. The developing device according to claim 1, wherein a linear velocity of the developer carrying unit is not less than 9000 mm/min.

3. The developing device according to claim 1, wherein the developing bias applied to the developer carrying unit does not include an alternating current component.

4. The developing device according to claim 1, wherein the magnetic field generating unit includes a magnetic pole configured to form the magnetic brush, wherein a decrement of a magnetic flux density in a normal direction of the developing magnetic pole is not less than 40%.

5. An image forming apparatus comprising:

a latent image carrying unit configured to carry a latent image;

a developing device configured to supply toner to the latent image so as to develop the latent image on the latent image carrying unit into a toner image;

a transferring device configured to transfer the toner image to a medium, wherein the developing device comprises:

a developer carrying unit including a non-magnetic sleeve rotatable and a magnetic field generating unit;

a developer receptacle configured to receive a two-component developer including toner and a magnetic carrier; and an opening through which a portion of the developer carrying unit opposite to the latent image carrying unit is exposed, wherein the magnetic field generating unit is configured to draw the two-component developer onto a surface of the developer carrying unit so as to carry the two-component developer to the opening, form a magnetic brush by erecting the two-component developer on the developer carrying unit at the opening, apply a developing bias on the developer carrying unit so as to develop the latent image with the toner supplied to the latent image on the latent image carrying unit from the magnetic brush, and an amount of weakly charged toner in the two-component developer passing through the opening per unit time is not greater than 200 g·mm/min, wherein the amount of weakly charged toner is expressed by an equation, which is $$\text{the amount of weakly charged toner [g·mm/min]} = \text{total amount of the two-component developer to be drawn [g/min]} \times \text{length of the opening [mm]} \times \text{a concentration of toner [wt \%]} \times \text{percentage of weakly charged toner [\%]}$$

wherein the total amount of the two-component developer to be drawn is expressed by an equation, which is $$\text{the total amount of the two-component developer to be drawn [g/min]} = \text{an amount of the two-component developer to be drawn [g/mm}^2\text{]} \times \text{drawing width [mm]} \times \text{linear velocity of a developing roller [mm/min]}$$

and the percentage of weakly charged toner [%] is a percentage of toner having a charge of not less than −0.1 fC/μm if the toner is negatively charged, and is a percentage of toner having a charge not greater than 0.1 fC/μm if the toner is positively charged, according to a distribution of charge per particle size, wherein the developing device is configured to move the magnetic brush in a direction in which the latent image carrying unit is moved and at a speed faster than that of the latent image carrying unit so as to bring the magnetic brush in contact with a surface of the latent image carrying unit and to develop the latent image.

6. The image forming apparatus according to claim 5, wherein an electric potential at a dark portion of the image carrying unit (hereinafter, "VD"), an electric potential after exposure to light (hereinafter, "VL"), and a developing bias voltage (hereinafter, "VB") satisfy an equation, which is $$0 < |VD| - |VB| < |VD - VL| < 250\ V$$

and a maximum quantity of toner adhered on the latent image carrying unit is controlled to be not greater than 1.5×X, wherein X is a minimum quantity of toner adhered on the latent image carrying unit required to obtain a saturated image density, and the minimum quantity X is expressed by an equation, which is X=particle size×true specific gravity/transfer rate×0.6 wherein the minimum quantity X is an amount of toner adhered when the toner exists in at least 60% of a space equivalent to a thickness of a particle size of toner.

7. The image forming apparatus according to claim 5, wherein the toner has an average circularity greater than 0.96.

8. A process cartridge comprising:

a latent image carrying unit configured to carry a latent image; and a developing device configured to supply toner onto the latent image so as to develop the latent image, wherein the latent image carrying unit and the developing device are structured as an integrated unit, the process cartridge is detachably connected to an image forming apparatus, and the developing device comprises:

a developer carrying unit including a non-magnetic sleeve rotatable and a magnetic field generating unit;

a developer receptacle configured to receive a two-component developer including toner and a magnetic carrier; and an opening through which a portion of the developer carrying unit opposite to the latent image carrying unit is exposed, wherein the magnetic field generating unit is configured to draw the two-component developer onto a surface of the developer carrying unit so as to carry the two-component developer to the opening, form a magnetic brush by erecting the two-component developer on the developer carrying unit at the opening, apply a developing bias on the developer carrying unit so as to develop the latent image with the toner supplied to the latent image on the latent image carrying unit from the magnetic brush, and an amount of weakly charged toner in the two-component developer passing through the opening per unit time is not greater than 200 g·mm/min, wherein the amount of weakly charged toner is expressed by an equation, which is the amount of weakly charged toner [g·mm/min] = total amount of the two-component developer to be drawn [g/min] × length of the opening [mm] × a concentration of toner [wt %] × percentage of weakly charged toner [%]

wherein the total amount of the two-component developer to be drawn is expressed by an equation, which is the total amount of the two-component developer to be drawn [g/min] = an amount of the two-component developer to be drawn [g/mm$^2$] × drawing width [mm] × linear velocity of a developing roller [mm/min]

and the percentage of weakly charged toner [%] is a percentage of toner having a charge of not less than −0.1 fC/μm if the toner is negatively charged, and is a percentage of toner having a charge not greater than 0.1 fC/μm if the toner is positively charged, according to a distribution of charge per particle size.

9. An image forming apparatus comprising:

a latent image carrying unit;

a developing device including a surface conveyor configured to convey toner charged to a predetermined polarity adhered electrostatically on a toner carrier charged to a polarity opposite to that of the toner charged to a developing region opposite to a surface of the image carrying unit, wherein in the developing region, the developing device is configured to transfer on a medium a toner image formed of the toner adhered on a latent image on a surface of the latent image carrying unit so as to form an image on the medium; and a toner-amount adjusting unit configured to adjust an amount of toner to be adhered on the toner carrier before the surface conveyor conveys the toner to the developing region such that in the developing region a total charge on the toner adhered on the toner carrier is not greater than a total charge on the toner carrier.

10. The image forming apparatus according to claim 9, wherein the developing device is configured to develop the latent image with a one-component developer including the toner, and a surface of the surface conveyor is the toner carrier.

11. The image forming apparatus according to claim 9, wherein the developing device develops the latent image with a two-component developer including the toner and a magnetic carrier, and the magnetic carrier is the toner carrier.

12. The image forming apparatus according to claim 9, wherein the toner-amount adjusting unit is configured to adjust the amount of toner to be adhered on the toner carrier such that a ratio of the total charge on the toner to the total charge on the toner carrier is not greater than 80%.

13. The image forming apparatus according to claim 9, wherein the toner-amount adjusting unit comprises a member configured to receive an alternating-current voltage, and is configured to form an alternating-current electric field between the member and the surface conveyor so as to adjust the amount of toner to be adhered on the toner carrier.

14. The image forming apparatus according to claim 9, wherein the toner-amount adjusting unit comprises a stirrer configured to stir the toner or a developer carried on a surface of the surface conveyor so as to adjust the amount of toner to be adhered on the toner carrier.

15. The image forming apparatus according to claim 9, wherein the toner carrier has a dynamic resistance of $1\times10^2$ ohms to $1\times10^{11}$ ohms.

16. The image forming apparatus according to claim 9, wherein the toner has an average circularity of not less than 96%.

17. A process cartridge detachable from an image forming apparatus, wherein the image forming apparatus comprises:

a latent image carrying unit;

a developing device including a surface conveyor configured to convey toner charged to a predetermined polarity adhered electrostatically on a toner carrier charged to a polarity opposite to that of the toner charged to a developing region opposite to a surface of the image carrying unit, wherein in the developing region, the developing device is configured to transfer on a medium a toner image formed of the toner adhered on a latent image on a surface of the latent image carrying unit so as to form an image on the medium; and a toner-amount adjusting unit configured to adjust an amount of toner to be adhered on the toner carrier before the surface conveyor conveys the toner to the developing region such that in the developing region a total charge on the toner adhered on the toner carrier is not greater than a total charge on the toner carrier, wherein the process cartridge comprises at least the latent image carrying unit, the developing device, and the toner-amount adjusting unit, which are structured as an integrated unit.

18. A developing device comprising:

a latent image carrying unit;

a developer receptacle having an opening facing the latent image carrying unit; and a developer carrying unit configured to be partially exposed to an inside of the developer receptacle through the opening, carry as a magnetic brush a two-component developer including toner and a carrier with a magnetic field generating unit included in the developer carrying unit, and supply the toner to a latent image on the latent image carrying unit in a developing region opposite to the latent image carrying unit, wherein a proportion of the toner satisfying equations, which are, $$\mu Fq < Fdmax \tag{C1}$$

$$Fq = \frac{k}{4\pi\varepsilon_0}\left(\frac{q}{r}\right)^2 \tag{C2}$$

$$Fdmax = \frac{4}{3}\pi \cdot r^3 \cdot \sigma \cdot a \tag{C3}$$

is not greater than 10%, wherein Fq is an electrostatic adherence of the toner with respect to the carrier in the two-component developer, Fdmax is a maximum inertial force exerted on the toner at the opening, μ is a coefficient of kinetic friction, π is pi, $\in_0$ is a dielectric constant in vacuum [F/m], k is a constant, q is an electric charge on toner particles [C], r is a radius of the toner particles [m], σ is a density [kg/m$^2$], and a is a change in velocity of the magnetic brush [m/s$^2$].

19. The developing device according to claim 18, wherein a maximum of a change in magnetic flux density of a magnetic flux density distribution at the opening of the developer receptacle due to the magnetic field generating unit in the developer carrying unit is not greater than 0.45 T/deg.

20. The developing device according to claim 19, wherein the magnetic field generating unit includes a magnetic pole located opposite to the developing region, and the maximum of the change in magnetic flux density of the magnetic flux density distribution due to the magnetic pole is not greater than 0.45 T/deg.

21. The developing device according to claim 18, wherein a particle size of the carrier is not greater than 35 micrometers.

22. The developing device according to claim 18, wherein the toner includes particle number ratio of not less than 70% of toner having a particle size from 3 micrometers to 7 micrometers.

23. The developing device according to claim 18, wherein a value obtained by dividing a weight average particle size by a number average particle size of the toner is not greater than 1.3.

24. A process cartridge comprising:

an image carrying unit configured to carry an electrostatic latent image; and a developing device configured to convey a developer carried on a developer carrying unit to a developing region opposite to the image carrying unit and to develop a latent image on the image carrying unit to form a toner image, wherein the process cartridge is configured to be detachable from an image forming apparatus, wherein the image forming apparatus comprises:

the image carrying unit;

a charging unit configured to charge the image carrying unit;

the developing device; and a cleaning unit configured to remove toner remained on the image carrying unit after the toner image is transferred onto a medium, wherein the developing device comprises:

the latent image carrying unit;

a developer receptacle having an opening facing the latent image carrying unit; and a developer carrying unit configured to be partially exposed to an inside of the developer receptacle through the opening, carry as a magnetic brush a two-component developer including toner and a carrier with a magnetic field generating unit included in the developer carrying unit, and supply the toner to a latent image on the latent image carrying unit in a developing region opposite to the latent image carrying unit, wherein a proportion of the toner satisfying equations, which are, $$\mu Fq < Fdmax \quad \text{(C1)}$$

$$Fq = \frac{k}{4\pi\varepsilon_0}\left(\frac{q}{r}\right)^2 \quad \text{(C2)}$$

-continued $$Fdmax = \frac{4}{3}\pi \cdot r^3 \cdot \sigma \cdot a \quad \text{(C3)}$$

is not greater than 10%, wherein Fq is an electrostatic adherence of the toner with respect to the carrier in the two-component developer, Fdmax is a maximum inertial force exerted on the toner at the opening, μ is a coefficient of kinetic friction, π is pi, $\in_0$ is a dielectric constant in vacuum [F/m], k is a constant, q is an electric charge on toner particles [C], r is a radius of the toner particles [m], σ is a density [kg/m$^2$], and a is a change in velocity of the magnetic brush [m/s$^2$].

25. The process cartridge according to claim 24, further comprising at least one of the charging unit and the cleaning unit.

26. An image forming apparatus comprising:

a latent image carrying unit;

a latent-image forming unit configured to form a latent image on the image carrying unit;

a developing device configured to develop the latent image on the image carrying unit; wherein the developing device comprises:

the latent image carrying unit;

a developer receptacle having an opening facing the latent image carrying unit; and a developer carrying unit configured to be partially exposed to an inside of the developer receptacle through the opening, carry as a magnetic brush a two-component developer including toner and a carrier with a magnetic field generating unit included in the developer carrying unit, and supply the toner to a latent image on the latent image carrying unit in a developing region opposite to the latent image carrying unit, wherein a proportion of the toner satisfying equations, which are, $$\mu Fq < Fdmax \quad \text{(C1)}$$

$$Fq = \frac{k}{4\pi\varepsilon_0}\left(\frac{q}{r}\right)^2 \quad \text{(C2)}$$

$$Fdmax = \frac{4}{3}\pi \cdot r^3 \cdot \sigma \cdot a \quad \text{(C3)}$$

is not greater than 10%, wherein Fq is an electrostatic adherence of the toner with respect to the carrier in the two-component developer, Fdmax is a maximum inertial force exerted on the toner at the opening, μ is a coefficient of kinetic friction, π is pi, $\in_0$ is a dielectric constant in vacuum [F/m], k is a constant, q is an electric charge on toner particles [C], r is a radius of the toner particles [m], σ is a density [kg/m$^2$], and a is a change in velocity of the magnetic brush [m/s$^2$].

27. An image forming apparatus comprising:

a latent image carrying unit configured to carry a latent image;

a latent-image forming unit configured to form the latent image on the latent image carrying unit;

a developing device configured to develop the latent image on the image carrying unit; and a process cartridge comprising:

the image carrying unit; and the developing device configured to convey a developer carried on a developer carrying unit to a developing region opposite to the latent image carrying unit and to develop the latent image on the image carrying unit to form a toner image, wherein the process cartridge is configured to be detachable from the image forming apparatus;

a charging unit configured to charge the image carrying unit; and a cleaning unit configured to remove toner remained on the latent image carrying unit after the toner image is transferred onto a medium, wherein the developing device comprises:

the latent image carrying unit;

a developer receptacle having an opening facing the latent image carrying unit; and the developer carrying unit configured to be partially exposed to an inside of the developer receptacle through the opening, and carry as a magnetic brush a two-component developer including toner and a carrier with a magnetic field generating unit included in the developer carrying unit, wherein a proportion of the toner satisfying equations, which are, $$\mu Fq < Fd\max \tag{C1}$$

$$Fq = \frac{k}{4\pi\varepsilon_0}\left(\frac{q}{r}\right)^2 \tag{C2}$$

$$Fd\max = \frac{4}{3}\pi \cdot r^3 \cdot \sigma \cdot a \tag{C3}$$

is not greater than 10%, wherein Fq is an electrostatic adherence of the toner with respect to the carrier in the two-component developer, Fdmax is a maximum inertial force exerted on the toner at the opening, μ is a coefficient of kinetic friction, π is pi, $\in_0$ is a dielectric constant in vacuum [F/m], k is a constant, q is an electric charge on toner particles [C], r is a radius of the toner particles [m], σ is a density [kg/m$^2$], and a is a change in velocity of the magnetic brush [m/s$^2$].

* * * * *